US009085919B2

(12) United States Patent
Bacon

(10) Patent No.: US 9,085,919 B2
(45) Date of Patent: Jul. 21, 2015

(54) TOUCH PAD LOCK ASSEMBLY

(75) Inventor: Bruce C. Bacon, Rockford, MI (US)

(73) Assignee: BAUER PRODUCTS, INC., Grand Rapids, MI (US)

( * ) Notice: Subject to any disclaimer, the term of this patent is extended or adjusted under 35 U.S.C. 154(b) by 645 days.

(21) Appl. No.: 13/424,512

(22) Filed: Mar. 20, 2012

(65) Prior Publication Data

US 2012/0192602 A1 Aug. 2, 2012

Related U.S. Application Data

(63) Continuation-in-part of application No. 13/368,778, filed on Feb. 8, 2012, now Pat. No. 8,393,187, which is a continuation-in-part of application No. 12/952,230, filed on Nov. 23, 2010, now Pat. No. 8,186,191, which (Continued)

(51) Int. Cl.
*E05B 59/00* (2006.01)
*E05B 47/02* (2006.01)

(Continued)

(52) U.S. Cl.
CPC ..... *E05B 59/00* (2013.01); *E05B 13/10* (2013.01); *E05B 47/026* (2013.01); *E05B 81/25* (2013.01); *E05B 81/66* (2013.01); *E05B 81/77* (2013.01);

(Continued)

(58) Field of Classification Search
CPC ..... E05B 59/00; E05B 13/10; E05B 47/0012; E05B 47/026; E05B 63/14; E05B 81/06; E05B 81/18; E05B 81/25; E05B 83/44; E05B 85/22; E05B 2047/0086; E05B 17/0083; E05B 17/10; E05B 81/66; E05B 81/77; E05B 85/18; E05B 81/82; E05C 1/14
USPC ..... 70/107–111, 278.7, 279.1, 278.1, 208, 70/210, 256, 257, 277, 280–283, 283.1, 70/278.2, 278.3; 292/144, DIG. 31
See application file for complete search history.

(56) References Cited

U.S. PATENT DOCUMENTS 145,835 A 12/1873 Bissell
374,391 A 12/1887 Born (Continued)

FOREIGN PATENT DOCUMENTS

DE 26 29 332 1/1978
GB 2 123 474 2/1984

OTHER PUBLICATIONS

Tri/Mark, "Travel Trailer Latch Dead Bolt Option—60-200 Series 60-250 Series," New Hampton, Iowa (date unknown, prior to Jun. 11, 2002).

(Continued)

*Primary Examiner* — Lloyd Gall
(74) *Attorney, Agent, or Firm* — Price Heneveld LLP

(57) ABSTRACT

A lock assembly for a closure comprises a housing, a handle pivotally mounted in an exterior portion of the housing and a latch operably connected with the handle. A key lock mounted on the exterior portion of the housing has a locked and an unlocked position. A lock cam rotatably mounted in the housing is operably connected with the key lock for rotation therewith. A deadbolt lock is operably connected to the lock cam via a crank arm and a link to a motor. An electronic touchpad mounted on the exterior portion of the housing is operatively connected with the motor, whereby entry of a preselected numerical code actuates the motor and contemporaneously shifts the deadbolt lock between locked and unlocked positions.

34 Claims, 10 Drawing Sheets

Related U.S. Application Data is a continuation-in-part of application No. 12/639,516, filed on Dec. 16, 2009, now Pat. No. 8,347,667.

(60) Provisional application No. 61/264,935, filed on Nov. 30, 2009, provisional application No. 61/203,403, filed on Dec. 22, 2008, provisional application No. 61/440,895, filed on Feb. 9, 2011.

(51) Int. Cl.

| | |
|---|---|
| ***E05B 13/10*** | (2006.01) |
| ***E05B 81/24*** | (2014.01) |
| ***E05B 85/22*** | (2014.01) |
| ***E05C 1/14*** | (2006.01) |
| ***E05B 81/66*** | (2014.01) |
| ***E05B 81/82*** | (2014.01) |
| *E05B 47/00* | (2006.01) |
| *E05B 63/14* | (2006.01) |
| *E05B 81/06* | (2014.01) |
| *E05B 81/18* | (2014.01) |
| *E05B 83/44* | (2014.01) |
| *E05B 17/00* | (2006.01) |
| *E05B 17/10* | (2006.01) |
| *E05B 85/18* | (2014.01) |

(52) U.S. Cl.

CPC ..... *E05B 81/82* (2013.01); *E05B 85/22* (2013.01); *E05C 1/14* (2013.01); *E05B 17/0083* (2013.01); *E05B 17/10* (2013.01); *E05B 47/0012* (2013.01); *E05B 63/14* (2013.01); *E05B 81/06* (2013.01); *E05B 81/18* (2013.01); *E05B 83/44* (2013.01); *E05B 85/18* (2013.01); *E05B 2047/0086* (2013.01)

(56) References Cited

U.S. PATENT DOCUMENTS

| | | | | | |
|---|---|---|---|---|---|
| 745,042 | A | | 11/1903 | Daves | |
| 1,071,567 | A | | 8/1913 | Outwater | |
| 1,141,463 | A | | 6/1915 | Hurd | |
| 1,478,381 | A | | 12/1923 | Crimmel | |
| 1,593,011 | A | | 7/1926 | Bourgon | |
| 1,596,992 | A | | 8/1926 | Ognowicz | |
| 1,654,489 | A | | 12/1927 | Teich | |
| 1,678,498 | A | | 7/1928 | Crimmel | |
| 1,805,891 | A | | 5/1931 | Shinn | |
| 1,807,804 | A | | 6/1931 | Stone | |
| 1,845,732 | A | | 2/1932 | Tournier et al. | |
| 1,964,066 | A | | 6/1934 | Kaszmaul | |
| 2,022,718 | A | | 12/1935 | Heins | |
| 2,097,407 | A | | 10/1937 | Spinello | |
| 2,112,372 | A | | 3/1938 | Lofgren | |
| 2,201,957 | A | | 5/1940 | North | |
| 2,202,056 | A | | 5/1940 | Kandetzki | |
| 2,241,785 | A | | 5/1941 | Lofgren | |
| 2,253,547 | A | | 8/1941 | Adams | |
| 2,263,180 | A | | 11/1941 | Lofgren | |
| 2,303,624 | A | * | 12/1942 | Edwards et al. | 70/110 |
| 2,322,948 | A | | 6/1943 | Lofgren | |
| 2,324,406 | A | | 7/1943 | Lofgren et al. | |
| 2,460,709 | A | | 2/1949 | Navarro | |
| 2,642,300 | A | | 6/1953 | Pelcin | |
| 2,668,076 | A | | 2/1954 | Troche et al. | |
| 2,735,706 | A | | 2/1956 | Pelcin | |
| 2,871,048 | A | | 1/1959 | Balogh | |
| 2,900,204 | A | | 8/1959 | Pelcin | |
| 2,987,908 | A | | 6/1961 | Pelcin | |
| 3,019,632 | A | | 2/1962 | Russell | |
| 3,027,188 | A | | 3/1962 | Eickstadt | |
| 3,080,743 | A | | 3/1963 | Stansberry | |
| 3,095,726 | A | | 7/1963 | Schlage | |
| 3,111,833 | A | | 11/1963 | Dettmer | |
| 3,190,093 | A | | 6/1965 | Schlage | |
| 3,234,765 | A | | 2/1966 | Kerr | |
| 3,283,549 | A | | 11/1966 | Mees | |
| 3,438,227 | A | | 4/1969 | Wolniak | |
| 3,514,979 | A | | 6/1970 | Wiesmann | |
| D218,672 | S | | 9/1970 | Lauper | |
| 3,563,071 | A | | 2/1971 | Barger | |
| 3,580,016 | A | | 5/1971 | Kerr | |
| 3,668,907 | A | | 6/1972 | Pastva, Jr. | |
| 3,707,862 | A | | 1/1973 | Pastva, Jr. | |
| D230,132 | S | | 1/1974 | Pastva, Jr. | |
| 3,782,141 | A | | 1/1974 | Doerrfeld | |
| 3,789,550 | A | | 2/1974 | Seiwert | |
| 3,998,080 | A | | 12/1976 | Fane | |
| 4,045,064 | A | | 8/1977 | Okada | |
| 4,052,092 | A | | 10/1977 | Bergen | |
| 4,075,879 | A | | 2/1978 | Christopher | |
| 4,138,869 | A | | 2/1979 | Pelcin | |
| 4,158,299 | A | | 6/1979 | Grabner et al. | |
| 4,237,709 | A | | 12/1980 | Krugener et al. | |
| 4,276,760 | A | | 7/1981 | Nolin | |
| 4,309,884 | A | | 1/1982 | Davis | |
| 4,312,197 | A | | 1/1982 | Carrion et al. | |
| 4,312,202 | A | | 1/1982 | Pastva, Jr. et al. | |
| 4,413,493 | A | | 11/1983 | Meinsen et al. | |
| 4,418,552 | A | | 12/1983 | Nolin | |
| 4,420,954 | A | | 12/1983 | Hieronymi et al. | |
| 4,438,964 | A | | 3/1984 | Peters | |
| 4,443,032 | A | | 4/1984 | Bonassi | |
| 4,474,393 | A | | 10/1984 | Kimura | |
| 4,508,379 | A | | 4/1985 | Mochida | |
| D281,665 | S | | 12/1985 | Winderman et al. | |
| 4,630,457 | A | | 12/1986 | Kincaid et al. | |
| 4,653,143 | A | | 3/1987 | Ketelhut et al. | |
| 4,677,834 | A | | 7/1987 | Hicks | |
| 4,683,741 | A | * | 8/1987 | Fields | 70/432 |
| 4,689,976 | A | | 9/1987 | Larsen | |
| 4,715,201 | A | | 12/1987 | Craig | |
| 4,725,085 | A | | 2/1988 | Hu et al. | |
| 4,732,417 | A | | 3/1988 | Yang | |
| 4,762,348 | A | | 8/1988 | Matsumoto | |
| 4,773,683 | A | | 9/1988 | Nakamura | |
| 4,778,206 | A | | 10/1988 | Matsumoto et al. | |
| 4,821,539 | A | | 4/1989 | Steinbach | |
| 4,850,209 | A | | 7/1989 | Weinerman et al. | |
| D303,617 | S | | 9/1989 | Russell et al. | |
| D303,618 | S | | 9/1989 | Russell et al. | |
| D303,621 | S | | 9/1989 | Russell et al. | |
| D303,922 | S | | 10/1989 | Russell et al. | |
| D304,155 | S | | 10/1989 | Russell et al. | |
| 4,892,338 | A | | 1/1990 | Weinerman et al. | |
| 4,934,800 | A | | 6/1990 | Choi | |
| 4,936,122 | A | | 6/1990 | Osada | |
| 4,966,018 | A | | 10/1990 | Hauber | |
| 4,967,305 | A | * | 10/1990 | Murrer et al. | 361/172 |
| 4,976,123 | A | | 12/1990 | Ceron et al. | |
| D314,131 | S | | 1/1991 | Russell et al. | |
| 4,986,576 | A | | 1/1991 | Anderson | |
| 5,027,625 | A | | 7/1991 | Krachten | |
| 5,042,853 | A | | 8/1991 | Gleason et al. | |
| 5,058,937 | A | | 10/1991 | Miehe et al. | |
| 5,060,991 | A | | 10/1991 | Davidian et al. | |
| 5,074,009 | A | | 12/1991 | Simonton et al. | |
| 5,119,654 | A | | 6/1992 | Ceron et al. | |
| 5,127,686 | A | | 7/1992 | Gleason et al. | |
| 5,174,456 | A | | 12/1992 | Grody | |
| 5,180,201 | A | | 1/1993 | Hauber | |
| 5,182,929 | A | | 2/1993 | Myers | |
| D339,050 | S | | 9/1993 | Gleason et al. | |
| 5,265,453 | A | | 11/1993 | Konii et al. | |
| 5,265,920 | A | | 11/1993 | Kaup et al. | |
| 5,299,844 | A | | 4/1994 | Gleason | |
| 5,301,989 | A | | 4/1994 | Dallmann et al. | |
| D346,731 | S | | 5/1994 | Larsen et al. | |
| 5,484,178 | A | | 1/1996 | Sandhu et al. | |
| D369,084 | S | | 4/1996 | McConnell et al. | |
| D371,500 | S | | 7/1996 | McConnell et al. | |
| 5,531,498 | A | | 7/1996 | Kowall | |
| D373,298 | S | | 9/1996 | Miehe et al. | |

(56) References Cited

U.S. PATENT DOCUMENTS

| | | | | |
|---|---|---|---|---|
| 5,564,295 | A | 10/1996 | Weinerman et al. | |
| 5,586,459 | A | 12/1996 | Bullock et al. | |
| 5,586,795 | A | 12/1996 | Sasaki | |
| 5,595,076 | A | 1/1997 | Weinerman et al. | |
| 5,606,882 | A | 3/1997 | Larsen et al. | |
| 5,611,227 | A | 3/1997 | Solovieff | |
| 5,697,238 | A * | 12/1997 | Oike | 70/373 |
| 5,711,506 | A | 1/1998 | Stillwagon | |
| D390,086 | S | 2/1998 | Weinerman et al. | |
| D394,373 | S | 5/1998 | Weinerman et al. | |
| 5,775,146 | A | 7/1998 | Edwards et al. | |
| 5,799,520 | A | 9/1998 | Laabs et al. | |
| 5,875,948 | A | 3/1999 | Sadler | |
| 5,884,948 | A | 3/1999 | Weinerman et al. | |
| 5,927,773 | A | 7/1999 | Larsen | |
| 5,964,110 | A | 10/1999 | Crocco et al. | |
| 5,975,597 | A | 11/1999 | Makiuchi et al. | |
| 6,032,500 | A * | 3/2000 | Collard et al. | 70/278.1 |
| 6,042,159 | A | 3/2000 | Spitzley | |
| 6,059,329 | A | 5/2000 | Spitzley | |
| 6,101,853 | A | 8/2000 | Herr | |
| 6,108,979 | A | 8/2000 | Saffran et al. | |
| 6,138,883 | A | 10/2000 | Jackson | |
| 6,203,086 | B1 | 3/2001 | Dirks | |
| D440,481 | S | 4/2001 | Bacon | |
| 6,220,649 | B1 | 4/2001 | Rife | |
| 6,257,030 | B1 | 7/2001 | Davis | |
| 6,309,008 | B1 | 10/2001 | Bacon | |
| 6,363,577 | B1 | 4/2002 | Spitzley | |
| 6,382,006 | B1 | 5/2002 | Field et al. | |
| 6,409,234 | B1 | 6/2002 | Larsen et al. | |
| 6,513,353 | B1 | 2/2003 | Weinerman et al. | |
| 6,604,393 | B2 | 8/2003 | Larsen et al. | |
| 6,629,441 | B2 | 10/2003 | Lavergne | |
| 6,651,467 | B1 | 11/2003 | Weinerman et al. | |
| D485,155 | S | 1/2004 | Bacon | |
| 6,685,240 | B2 | 2/2004 | Bacon | |
| 6,701,761 | B1 * | 3/2004 | Chang et al. | 70/337 |
| 6,708,537 | B1 | 3/2004 | Eschweiler et al. | |
| 6,758,503 | B2 | 7/2004 | Sadler | |
| 6,845,641 | B2 | 1/2005 | Hsieh | |
| 6,854,304 | B2 | 2/2005 | Linares | |
| 6,857,298 | B2 | 2/2005 | Linares | |
| 6,962,375 | B2 | 11/2005 | Linares | |
| 7,028,514 | B2 | 4/2006 | Banks | |
| 7,034,655 | B2 | 4/2006 | Magner et al. | |
| 7,070,216 | B2 | 7/2006 | von zur Muehlen | |
| 7,097,216 | B2 | 8/2006 | Lane | |
| D529,367 | S | 10/2006 | Zweibohnmer et al. | |
| 7,119,709 | B2 | 10/2006 | Magner et al. | |
| 7,155,946 | B2 | 1/2007 | Lee et al. | |
| 7,168,755 | B2 | 1/2007 | Munezane | |
| 7,236,085 | B1 * | 6/2007 | Aronson et al. | 340/5.64 |
| 7,237,812 | B2 | 7/2007 | Tweedy | |
| 7,363,786 | B2 | 4/2008 | Terhaar et al. | |
| 7,401,484 | B1 | 7/2008 | Holmes et al. | |
| 7,520,152 | B2 | 4/2009 | Sabo et al. | |
| 7,819,444 | B2 | 10/2010 | Kagawa et al. | |
| 7,874,972 | B2 * | 1/2011 | Hayasaka et al. | 494/12 |
| 8,141,400 | B2 * | 3/2012 | Sorensen et al. | 70/279.1 |
| 8,186,191 | B2 * | 5/2012 | Bacon | 70/208 |
| 8,347,667 | B2 * | 1/2013 | Bacon | 70/107 |
| 8,393,187 | B2 * | 3/2013 | Bacon | 70/107 |
| 8,733,139 | B2 * | 5/2014 | Pickar | 70/208 |
| 2002/0092331 | A1 * | 7/2002 | Huang | 70/107 |
| 2003/0010073 | A1 | 1/2003 | Larsen et al. | |
| 2003/0226384 | A1 | 12/2003 | Shedd et al. | |
| 2004/0040353 | A1 * | 3/2004 | Yu et al. | 70/107 |
| 2004/0074269 | A1 | 4/2004 | Lee | |
| 2004/0134245 | A1 * | 7/2004 | Jasper | 70/92 |
| 2005/0044908 | A1 * | 3/2005 | Min | 70/276 |
| 2005/0179517 | A1 * | 8/2005 | Harms et al. | 340/5.9 |
| 2006/0049647 | A1 | 3/2006 | von zur Muehlen | |
| 2006/0260203 | A1 | 11/2006 | Wong et al. | |
| 2007/0001479 | A1 | 1/2007 | Fukuda et al. | |
| 2007/0056338 | A1 | 3/2007 | Sabo et al. | |
| 2007/0163312 | A1 | 7/2007 | Shen | |
| 2008/0127686 | A1 * | 6/2008 | Hwang | 70/107 |
| 2008/0258867 | A1 | 10/2008 | Harris et al. | |
| 2010/0300162 | A1 | 12/2010 | Cappuccio et al. | |
| 2010/0321173 | A1 | 12/2010 | Magner et al. | |

OTHER PUBLICATIONS

Tri/Mark, "Tri/Mark Designers & Manufacturers of Vehicle Hardware Products," New Hampton, Iowa (1996).

* cited by examiner

TOUCH PAD LOCK ASSEMBLY

CROSS-REFERENCE TO RELATED APPLICATIONS AND CLAIM TO PRIORITY

This application is a continuation-in-part of and claims priority under 35 U.S.C. §120 to commonly assigned, related U.S. Pat. No. 8,347,667, issued Jan. 8, 2013, entitled LOCK ASSEMBLY FOR CLOSURES AND THE LIKE, which claimed priority under 35 U.S.C. §119(e) to U.S. Provisional Application No. 61/203,403, filed Dec. 22, 2008; and further is a continuation-in-part of and claims priority under 35 U.S.C. §120 to commonly assigned, related U.S. Pat. No. 8,186,191, issued May 29, 2012, entitled REMOTELY OPERATED LOCK ASSEMBLY FOR CLOSURES AND THE LIKE, which claimed priority under 35 U.S.C. §119(e) to U.S. Provisional Patent Application No. 61/264,935, filed Nov. 30, 2009, the entire disclosures of which are incorporated herein by reference. This application is also a continuation-in-part and claims priority under 35 U.S.C. §120 to commonly assigned, related U.S. patent application Ser. No. 13/368,778, filed Feb. 8, 2012, now U.S. Pat. No. 8,393,187, issued Mar. 12, 2013, entitled REMOTELY OPERATED LOCKING HANDLE LATCH ASSEMBLY, which claimed priority under 35 U.S.C. §119(e) of U.S. Provisional Application No. 61/440,895, filed Feb. 9, 2011, the entire disclosure of which is incorporated herein by reference.

BACKGROUND OF THE INVENTION

The present invention relates to lock assemblies for movable closures and the like, and, in particular, to a lock assembly that can be actuated either manually, via a touch pad, or via a remote control.

Lock assemblies are generally well-known in the art, and are typically flush mounted on an associated closure or door to facilitate selectively shifting the closure between an open unlocked position and a closed locked position. Paddle handle assemblies are used widely on entry doors for recreational vehicles, motor homes, and the like, and in such applications require that the latch mechanism be accessible and operable from both the inside and the outside of the vehicle and that they include a deadbolt lock for maximum security.

Heretofore, paddle handle assemblies have proven generally effective, although they experience certain drawbacks. For example, most prior art paddle handle assemblies require that the latch lock and the deadbolt lock be actuated through manual lock cylinders and key locks. Also, such prior art paddle handle assemblies are not particularly adapted for use with remotely operated signaling devices, which have become quite popular in the vehicle industry. Furthermore, some prior art paddle handle assemblies experience a problem in maintaining the alignment between the deadbolt and the associated strike. Also, many prior art paddle handle assemblies have a rather complicated construction, which is expensive to manufacture and difficult to repair. Hence, a paddle handle assembly which overcomes these drawbacks would be advantageous.

SUMMARY OF THE INVENTION

One aspect of the present invention is a lock assembly adapted for mounting adjacent an associated closure of the type that can be shifted between an open position and a closed position, comprising a housing. An external handle is pivotally mounted in an exterior portion of the housing for rotation between a retracted position and an extended position. A latch is operably connected with the external handle and configured such that when the external handle is in the retracted position, the latch is in a latched position, wherein the closure cannot be unintentionally shifted from the closed position, and when the external handle is in the extended position, the latch is in an unlatched position, wherein the closure is free to be shifted from the closed position to the open position. A key lock is mounted on the exterior portion of the housing, where the key lock has a locked and an unlocked position. A lock cam is rotatably mounted in the housing and operably connected with the key lock for rotation therewith, the lock cam having a lock cam crank arm, where a first link is operably connected with the lock cam crank arm. A deadbolt lock is movably mounted in the housing for shifting between a locked position, wherein the closure is positively retained in the closed position, and an unlocked position, wherein the closure is free to be shifted between the open and closed positions, the deadbolt lock being operably connected with the first link. A motor having a locked and unlocked position and operatively connected with a first link and an electronic touchpad mounted on the exterior portion of the housing is operatively connected with the motor, whereby entry of a preselected numerical code actuates the motor and contemporaneously shifts the deadbolt lock between the locked and unlocked positions.

Another aspect of the present invention is a lock assembly that includes a motor crank arm operably connected with the first link and the motor to shift the deadbolt lock between the locked and unlocked positions.

A further is aspect of the present invention is a lock assembly including a second link operably connected with the motor crank arm and the deadbolt lock; wherein rotation of the lock cam operates through the second link to rotate the motor crank arm and rotation of the motor crank arm operates through the first link to shift the deadbolt lock between the locked and unlocked positions.

Still another aspect of the present invention is a lock assembly wherein actuation of the motor operates through the second link to rotate the lock cam and through the first link to shift the deadbolt lock between the locked and unlocked positions.

Yet a further aspect of the present invention is a lock assembly including a deadbolt slidably mounted in the housing with an outer end thereof which extends exterior of the housing for engagement with an associated strike adjacent the closure, an inner end thereof which extends interior of the housing, the first link having a first end thereof pivotally connected with the inner end of the deadbolt lock, and a second end thereof pivotally connected with a motor crank arm, such that actuation of the motor between the locked and unlocked positions longitudinally shifts the deadbolt lock between the locked and unlocked positions.

Another aspect of the present invention is a lock assembly wherein the second link has a first end thereof pivotally connected with the motor crank arm and a second end thereof pivotally connected with the crank arm of the motor cam, such that rotation of the key lock between the locked and unlocked positions longitudinally shifts the deadbolt lock between the locked and unlocked positions.

An additional aspect of the present invention is a lock assembly including a fixed interior handle operably connected with an interior portion of the housing and shaped to facilitate manually shifting the closure between the open and closed positions from an interior side of the closure, the fixed handle having a ramp-shaped leading edge to avoid interference with an adjacent sliding closure.

A further aspect of the present invention is a lock assembly including an interior lock actuator mounted on the interior portion of the housing, and operably connected with the lock cam for rotation therewith, such that shifting the interior lock actuator between locked and unlocked positions shifts the deadbolt lock between the locked and unlocked positions.

A still further aspect of the present invention is a lock assembly wherein the external handle includes an external handle key lock assembly and a protruding lock pawl which rotates with the external handle key lock assembly between a locked and an unlocked position, and a handle recess in the exterior portion of the housing for receiving the handle, the handle recess having a lock recess that engages the protruding lock pawl to prevent the handle from pivoting when the external handle key lock assembly is placed in the locked position.

Another aspect of the present invention is a lock assembly wherein the slideable deadbolt has a cross-sectional lateral thickness that is narrower than a cross-sectional lateral thickness of the latch to prevent interference between the deadbolt and the associated deadbolt strike as the deadbolt is moved between the locked and unlocked positions.

Yet a further aspect of the present invention is a lock assembly wherein an outer end of the slideable deadbolt is tapered.

Still another aspect of the present invention is a lock assembly wherein the latch has an outer end that extends exterior of the housing for engagement with an associated latch strike having a door strike recess and an inner end thereof which extends interior of the housing, the outer end of the latch further having an inclined surface that faces the door strike recess on the strike, and a slideable deadbolt having an outer end that extends exterior of the housing for engagement with an associated deadbolt strike located inboard of the inclined surface.

Yet another aspect of the present invention is a lock assembly wherein rotation of the lock cam and the motor crank arm to shift the deadbolt lock to the locked position places the first and second link in substantially end-to-end relationship to prevent an outer end of a slideable deadbolt from being pushed internally into the handle while in the locked position.

A still further aspect of the present invention is a lock assembly further comprising water diversion channels disposed on an internal surface of an exterior plate to divert water between the exterior plate and an internal plate away from the motor.

Another aspect of the present invention is a lock assembly further comprising water diversion ribs provided on an external surface of the exterior plate to divert water on the external surface of the exterior plate away from the external handle and the internal surface of the exterior plate.

An additional aspect of the present invention is a lock assembly adapted for mounting on an associated closure and the like of the type that can be moved between an open position and a closed position and that have an exterior and an interior surface extending between an exterior and an interior surface of the closure. The lock assembly adapted for mounting on an associated closure, the housing having an exterior plate juxtaposed against the exterior surface of the closure and an interior plate juxtaposed against the interior surface of the closure, the exterior and interior plates attached one to the other between the exterior and interior surfaces of the closure. A handle is pivotally mounted upon the exterior plate of the housing for rotation between a retracted position and an extended position. A latch is operably connected with the handle, and configured such that when the handle is in the retracted position, the latch is in a latched position, wherein the closure cannot be unintentionally shifted from the closed position, and when the handle is in the extended position, the latch is in an unlatched position, wherein the closure is free to be moved from the closed position to the open position. A key lock is mounted on the exterior plate of the housing, where the key lock has a locked and an unlocked position. A lock cam is rotatably mounted in the housing and operably connected with the key lock for rotation therewith, the lock cam having a crank arm, and a first link is operably connected with the crank arm. A deadbolt lock is movably mounted in the housing for shifting between a locked position, wherein the closure is positively retained in the closed position, and an unlocked position, wherein the closure is free to be shifted between the open and closed positions. The deadbolt lock is operably connected with the first link on the lock cam and a motor is operatively connected with the first link. An electronic touchpad is mounted on an exterior portion of the housing and is operatively connected with the motor, whereby entry of a preselected numerical code actuates the motor and contemporaneously shifts the deadbolt lock between the locked and unlocked positions. Water diversion channels are provided on an internal surface of the exterior plate to divert water between the exterior plate and an internal plate away from the motor.

Yet another aspect of the present invention is a lock assembly wherein the electronic touchpad further comprises a controller.

Another aspect of the present invention is a lock assembly further comprising a device to sense the position of the deadbolt lock and to determine whether the deadbolt lock is in the locked or unlocked position.

Still another aspect of the present invention is a lock assembly comprising a sensor cam positioned on the lock cam, where the device to sense the position of the deadbolt lock and to determine whether the deadbolt lock is in locked or unlocked position includes a depression switch mounted such that when the deadbolt lock is moved to the unlocked position, the sensor cam depresses the micro switch for determining whether the deadbolt lock is in the locked or unlocked position to signal that the deadbolt lock is in the unlocked position, and when the deadbolt lock is moved to the locked position, the micro switch is not depressed to signal that the deadbolt lock is in the locked position.

A still further aspect of the present invention is a paddle lock assembly wherein failure of the sensor cam to depress the micro switch within a predetermined time interval signals to the controller that the deadbolt lock is not free to move from the unlocked to the locked position.

A yet further aspect of the present invention is a lock assembly comprising a battery pack for powering the controller and further comprising a sensor for determining the charge of the battery pack and a signaling device responsive to a low battery charge.

Yet an additional aspect of the present invention is a lock assembly comprising a sensor for determining the proximity of a hand of a user and illuminators that illuminate the touchpad to facilitate entry of the code in response to a signal from the sensor for determining the proximity of a hand of a user.

Another aspect of the present invention is a lock assembly wherein the preselected numerical code can be modified by a user of the touchpad.

Yet another aspect of the present invention is a locking paddle handle assembly that has an uncomplicated design which is efficient in use, economical to manufacture, capable of a long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
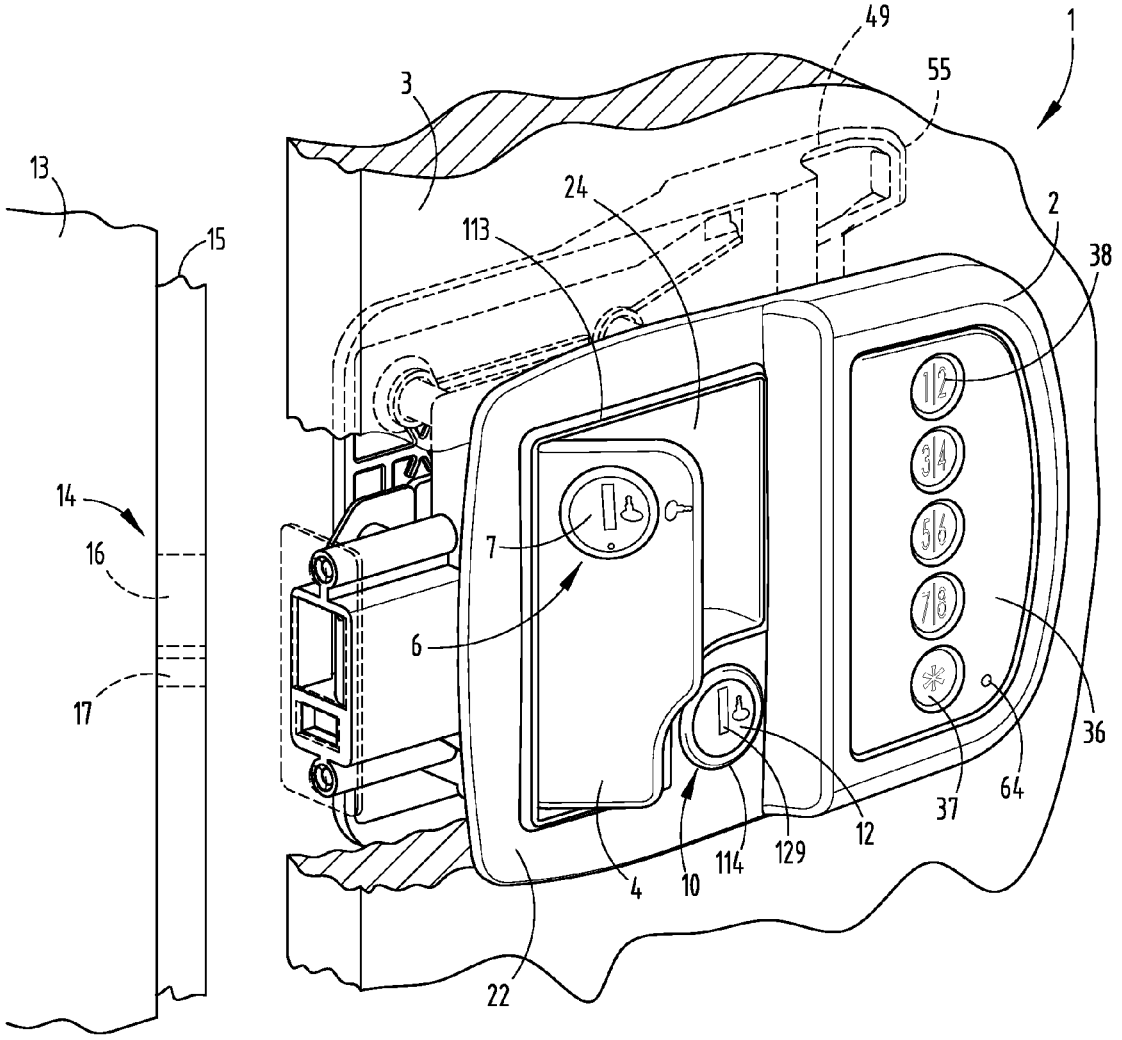
FIG. 1 is a perspective view of a lock assembly embodying the present invention, shown mounted in an associated closure.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 18:
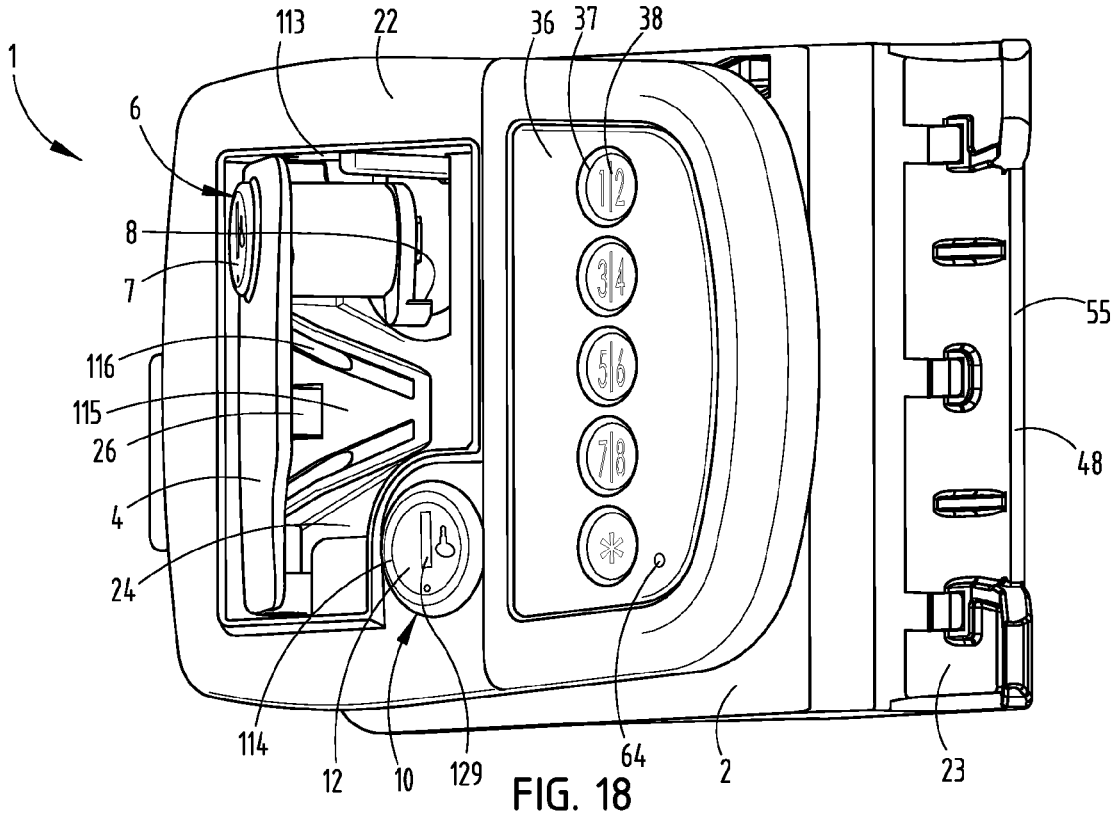
FIG. 18 is an oblique side view of the exterior side of the paddle handle latch assembly, with the paddle handle in the extended position.
Figure 19:
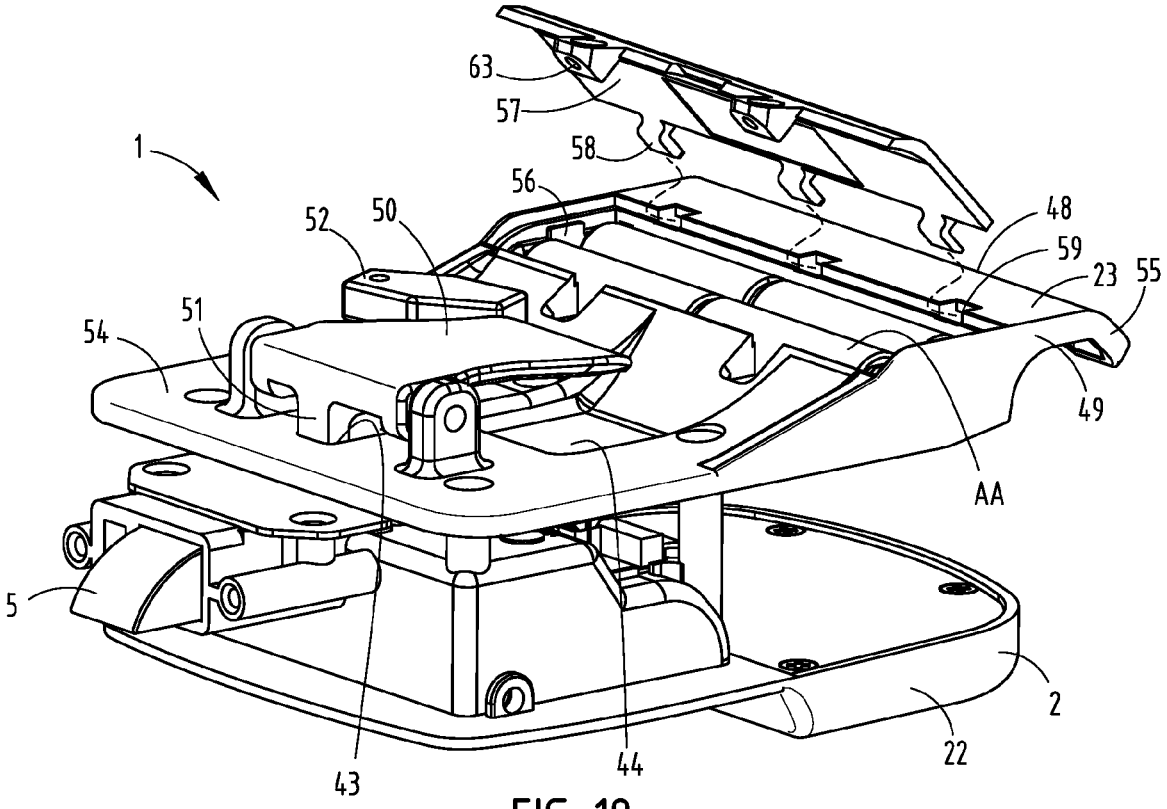
FIG. 19 is a perspective view of the interior side of the lock assembly, shown with the deadbolt lock in the unlocked position.

The reference numeral 1 in the Figures generally designates a lock assembly 1 embodying the present invention. Lock assembly 1 includes a housing 2 adapted for mounting in or adjacent to an associated closure 3 of the type that can be shifted between an open position (FIG. 1) and a closed position. A paddle handle 4 is pivotally mounted in an exterior portion of housing 2 for rotation between a retracted position (FIGS. 6-7) and an extended position (FIGS. 1 and 18). A latch 5 is operably connected with paddle handle 4, and configured such that when paddle handle 4 is in the retracted position, latch 5 is in a latched position (FIGS. 6-7), wherein closure 3 cannot be unintentionally shifted from the closed position, and when paddle handle 4 is in the extended position, latch 5 is in an unlatched position (FIGS. 1 and 18), wherein closure 3 is free to be shifted from the closed position to the open position.

Figure 6:
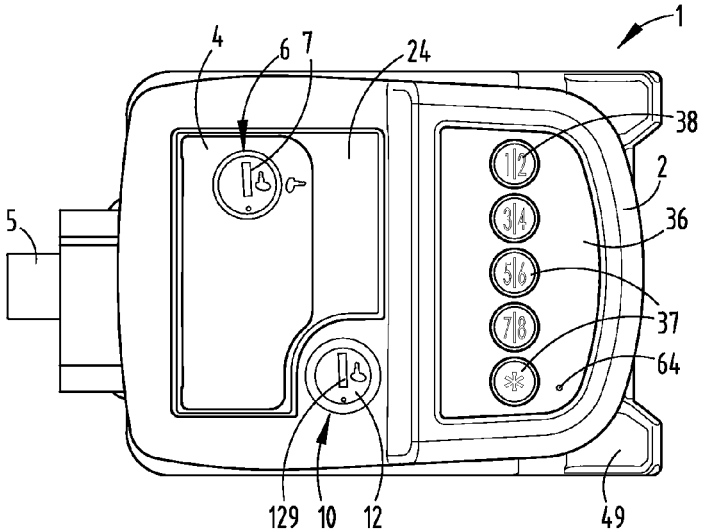
FIG. 6 is a front elevational view of the lock assembly.
Figure 7:
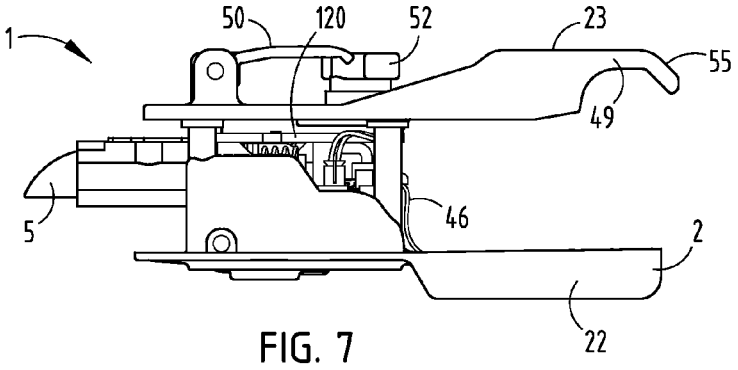
FIG. 7 is a top plan view of the lock assembly.
Figure 17:
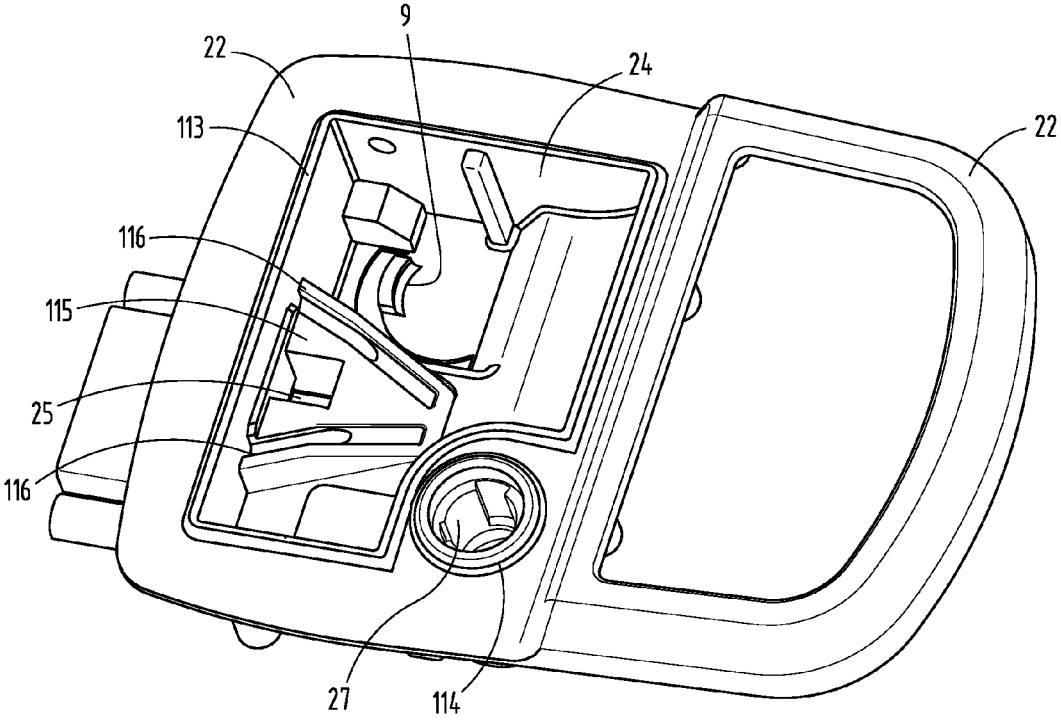
FIG. 17 is a perspective view of the exterior side of the exterior plate of the paddle handle latch assembly.

A paddle handle key lock 6 is preferably mounted on the exterior portion of paddle handle 4, and includes a movable key lock member 7 that is selectively movable between a locked position and an unlocked position. A paddle handle lock pawl 8 is movably mounted in paddle handle 4, operable connected with movable key lock member 7, and configured such that when movable key lock member 7 is in the locked position, paddle lock pawl 8 engages a paddle handle lock recess 9 (FIG. 17) in which paddle handle 4 is retained in the retracted position (FIGS. 6-7). When movable key lock member 7 is in the unlocked position, paddle handle lock pawl 8 assumes an unlocked position in which paddle handle 4 is free to be shifted between the retracted and the extended positions. Key lock 6 is substantially identical to deadbolt key lock 11 (described below). The aforementioned locking paddle handle is particularly beneficial for use when the associated vehicle is displayed on a large sales lot or the like, wherein key lock 6 is keyed to accept a master dealer key that can be used to gain interior access to a large number of recreational vehicles for sales purposes.

A deadbolt lock 10 is mounted in housing 2 for shifting between a locked position (FIG. 3), wherein closure 3 is positively retained in the closed position, and an unlocked position (FIG. 2), wherein closure 3 is free to be shifted between the open and closed positions. Dead-bolt lock 10 is operably connected with deadbolt key lock 11, with a movable deadbolt key lock member 12, such that movement of movable deadbolt key lock member 12 between the locked and unlocked positions contemporaneously shifts deadbolt lock 10 between the locked and unlocked positions.

In the example illustrated in FIG. 1, the closure 3 in which lock assembly 1 is mounted comprises an entry door for a recreational vehicle, motor home, trailer, shed, or the like, which can be pivotally shifted between open and closed positions along a substantially vertical hinge axis. Closure 3 selectively engages an associated doorframe 13 having a jamb section 14 in which a door strike 15 is mounted. Door strike 15 includes horizontally extending recesses 16, 17 extending into the jamb section 14 into which an associated portion of latch 5 and deadbolt 80 engages and disengages, respectively, to selectively retain closure 3 in the fully closed position, as described in greater detail hereinafter. Of course, recesses 16 and 17 can be combined into a single recess.

Figure 4:
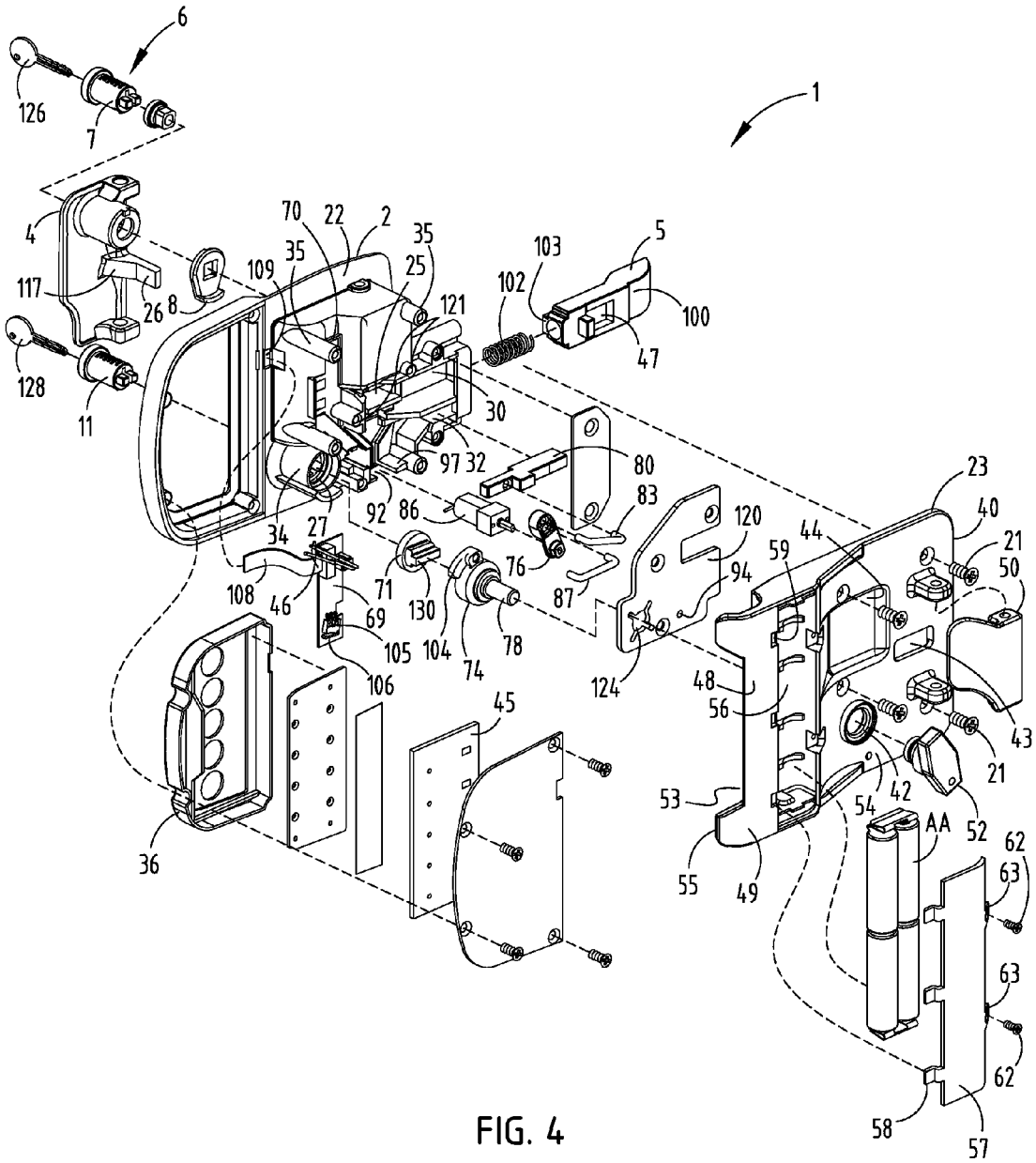
FIG. 4 is an exploded, perspective view of the lock assembly, taken from an interior side.
Figure 4A:
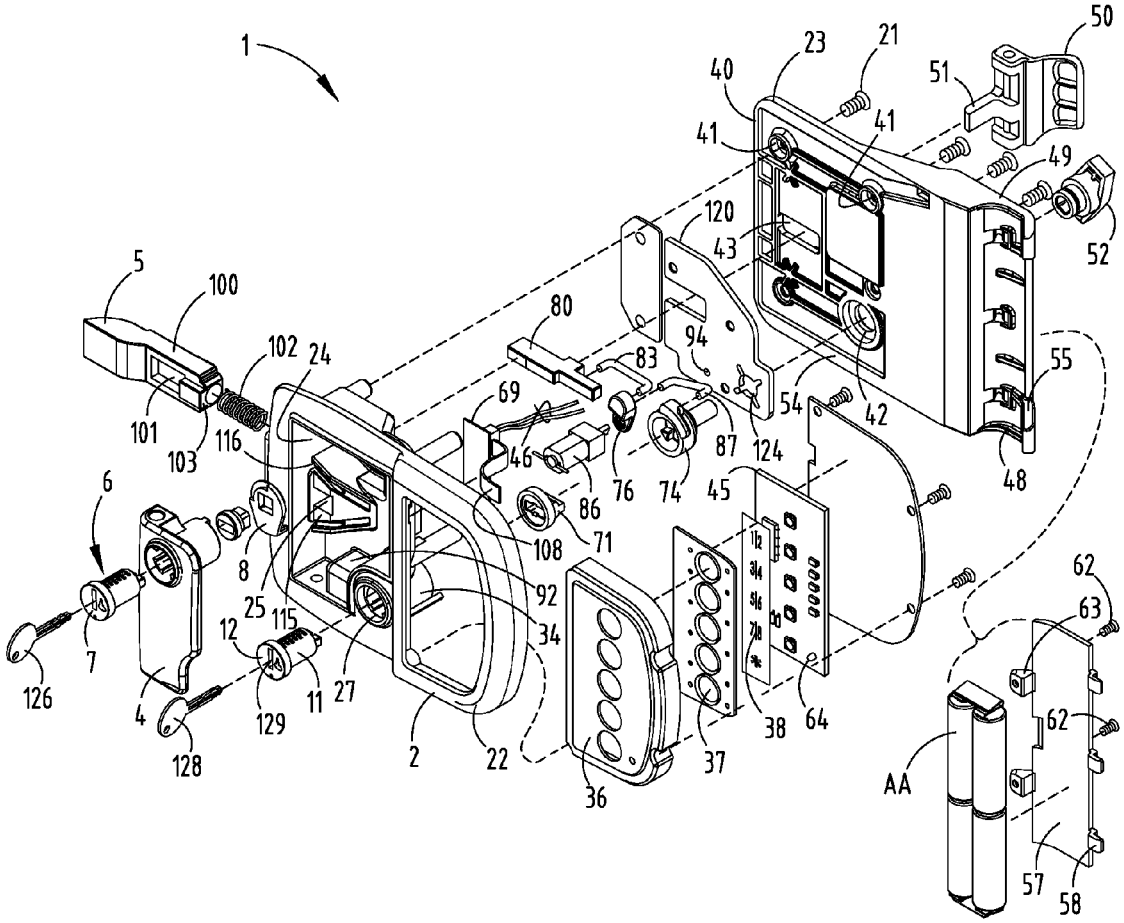
FIG. 4A is an exploded, perspective view of the lock assembly, taken from an exterior side thereof.
Figure 5:
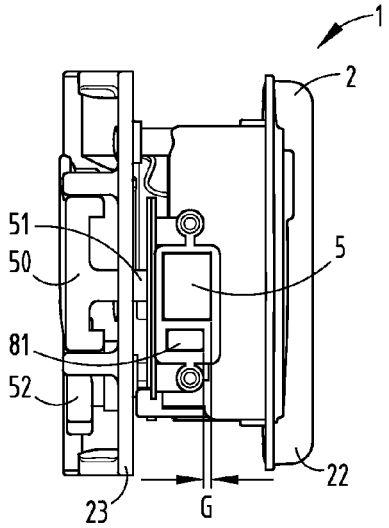
FIG. 5 is a side elevational view of the lock assembly.

As best illustrated in FIGS. 4-4A, 5, and 7, the housing 2 has a two-part construction, comprising an exterior plate 22 in which paddle handle 4 is pivotally mounted, and an interior plate 23 which mounts on the interior of closure 3 and is attached to exterior plate 22 by fasteners 21. The illustrated exterior plate 22 includes a centrally disposed, bowl-shaped recess 24 located directly behind paddle handle 4 which provides finger access to facilitate rotation of paddle handle 4 between the retracted and extended positions. The bottom wall of recess 24 includes an actuator window 25 through which an actuator tab 26 on paddle handle 4 extends to operate latch 5, as described in greater detail hereinafter, and also includes on a marginal portion the paddle handle lock recess 9, described above. The marginal portion of exterior plate 22 includes a lock aperture 27 in which deadbolt key lock 10 is mounted. A touchpad 36 containing a plurality of buttons 37, each preferably having numerical indicia 38 thereon, as best shown in FIGS. 1 and 4A, is located on the exterior of the exterior plate 22 and can be used to actuate the lock assembly 1, as described below.

Figure 2:
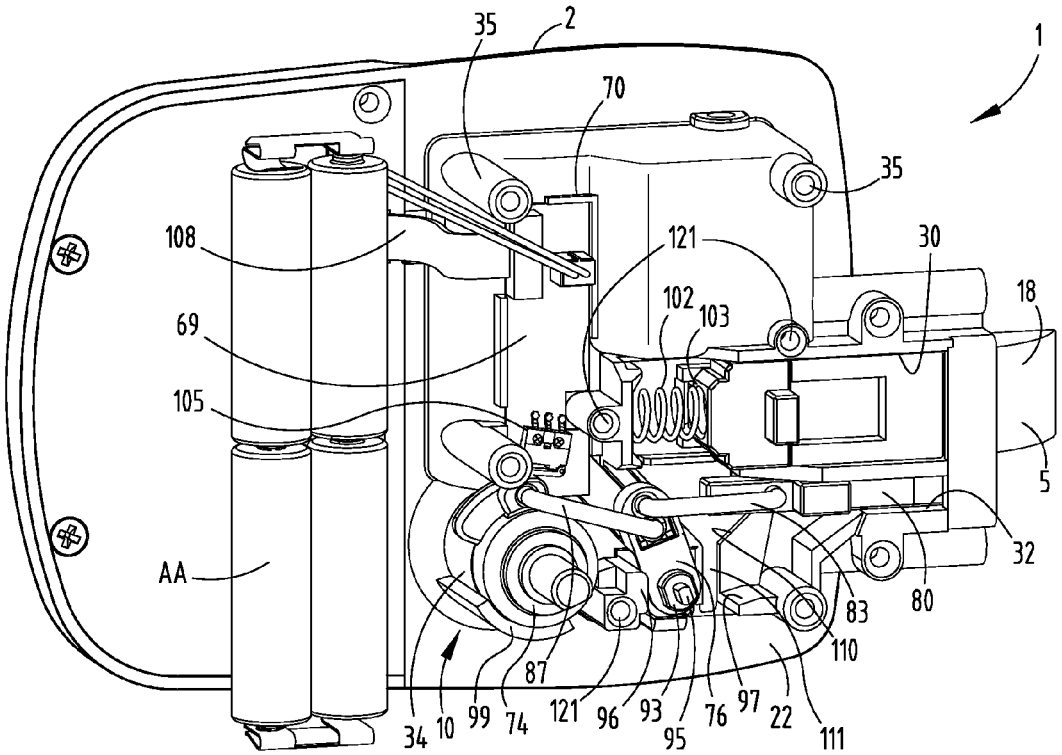
FIG. 2 is a perspective view of an interior portion of the exterior plate of the lock assembly, shown with a latch portion in a latched position, and deadbolt lock portions thereof in an unlocked position.
Figure 3:
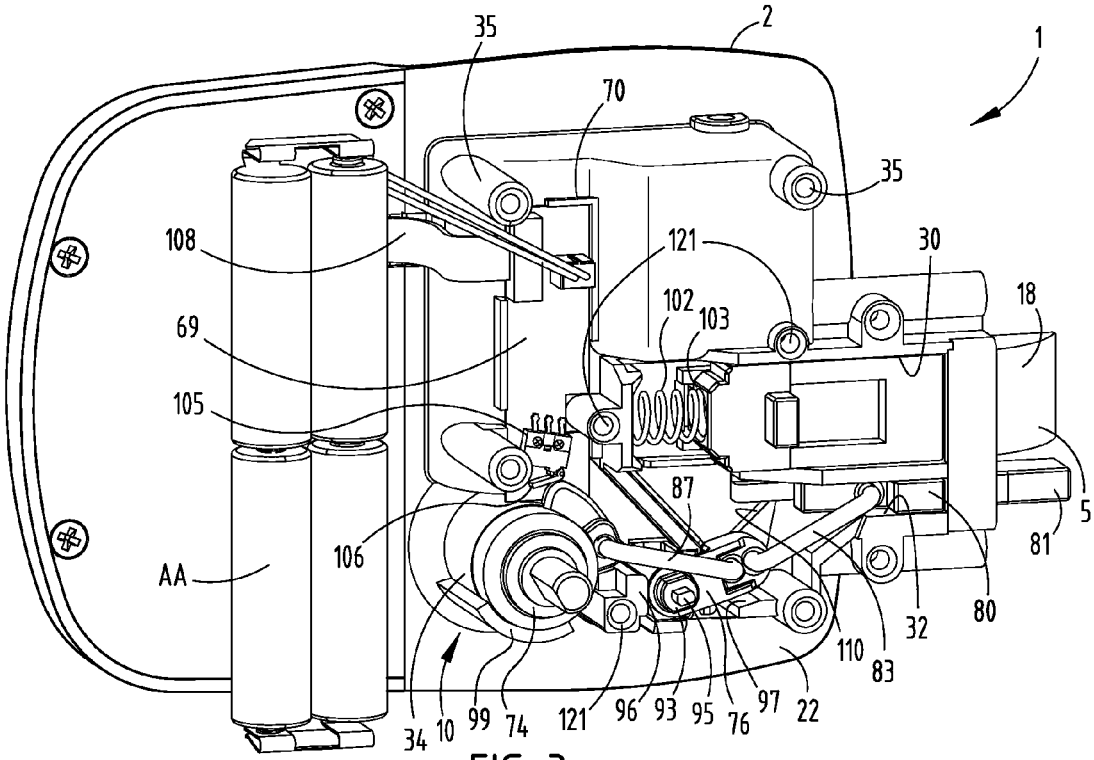
FIG. 3 is a perspective view of the interior portion of the exterior plate of the lock assembly, shown with the latch in a latched position, and deadbolt lock in a locked position.

As best illustrated in FIGS. 2-4, the inside surface of exterior plate 22 includes a centrally disposed, horizontally extending latch slide channel 30 and a horizontally extending deadbolt lock slide channel 32 disposed vertically below latch slide channel 30 for mounting therein associated portions of lock assembly 1, as described in greater detail hereinafter. The inside surface of the exterior plate 22 also includes a cylindrically shaped lock boss 34, the interior of which defines lock aperture 27, and a plurality of rearwardly projecting fastener bosses 35 which facilitate connection of interior plate 23 to exterior plate 22 using fasteners 21. The inside surface of the exterior plate 22 also includes a microchip or controller 45 and motor 86, as further described below.

Figure 8:
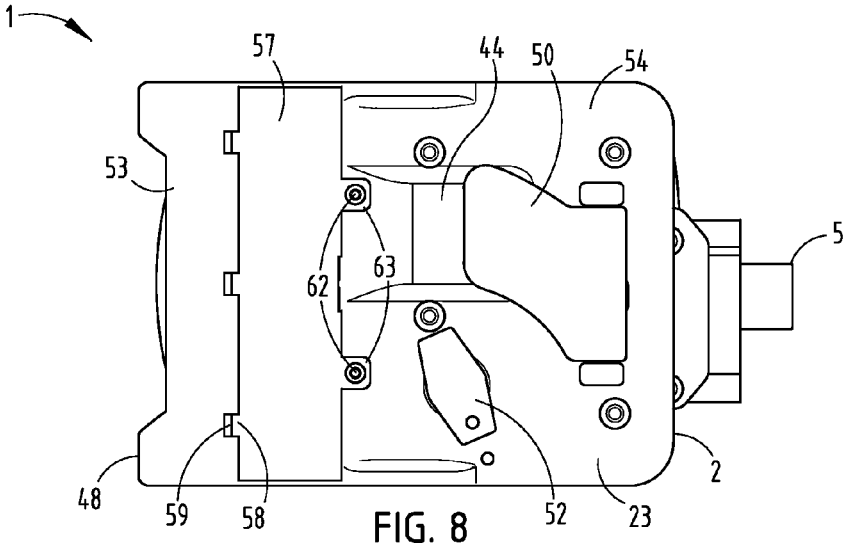
FIG. 8 is a rear elevational view of the lock assembly.

The interior plate 23 (FIGS. 4-4A and 8) of housing 2 includes a marginal portion 40 which engages the interior surface of closure 3, as well as fastener bosses 41, a lock boss 42, a centrally disposed actuator window 43, and a finger recess 44. The rearwardmost or interior side edge 48 of interior plate 23 is contoured inwardly to define a stationary interior handle 49 which facilitates opening and closing closure 3 from the interior portion of the vehicle. A release lever 50 is pivotally mounted on the inner surface of interior plate 23 and extends generally over finger recess 44. Release lever 50 includes a protruding actuator tab 51 which extends through actuator window 43 in interior plate 23 and into an interior pocket 47 in the slide portion 100 of latch 5 to selectively shift the same to the unlatched position, as described in greater detail below. An interior lock knob 52 is pivotally received in lock boss 42 on interior plate 23 and is operably connected with the movable key lock member 12 of deadbolt key lock 11 to lock and unlock deadbolt slide 80 as described below.

As best illustrated in FIGS. 4 and 7, interior handle 49 is formed integrally with interior plate 23 along a rearwardmost side edge 48 thereof, and includes a central cut-away area 53 for finger access to facilitate shifting closure 3 between the open and closed positions. Interior handle 49 has a flat portion 54 disposed substantially coplanar with the innermost surfaces of release lever 50 and lock knob 52. Furthermore, interior handle 49 includes a downwardly angled exterior portion 55 in which cut-away area 53 is formed, and is disposed in an inwardly angled orientation with respect to flat portion 54. The ramp-shaped exterior portion 55 of interior handle 49 deflects or leads a pleated or sliding screen over the interior of lock assembly 1, so as to avoid interference. The recess 44 achieves a low profile, while facilitating grasping and rotating interior release lever 50.

The interior plate 23 is also provided with a battery compartment 56 disposed between the interior handle 49 and the interior lock knob 52 and release lever 50. The battery compartment 56 is preferably adapted to receive four AA batteries, which are common and easy to install. A battery compartment cover 57 is removably attached to the interior plate 23 through tabs 58 that are received within recesses 59 on one edge of the battery compartment 56 and fasteners 62 that secure attachment tabs 63 to the opposite edge of the battery compartment 56. The batteries in the battery compartment 56 in the interior plate 23 are electrically coupled through power lines 46 to provide electrical power to the controller 45 and motor 86 mounted on the exterior housing plate 22, as described below.

Figure 11:
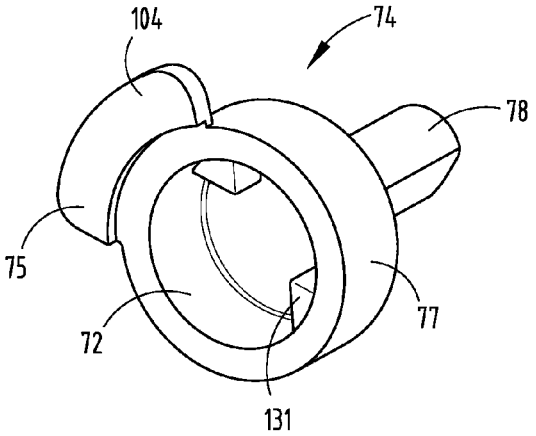
FIG. 11 is an enlarged, perspective view of a lock cam portion of the lock assembly, taken from an exterior side thereof.
Figure 12:
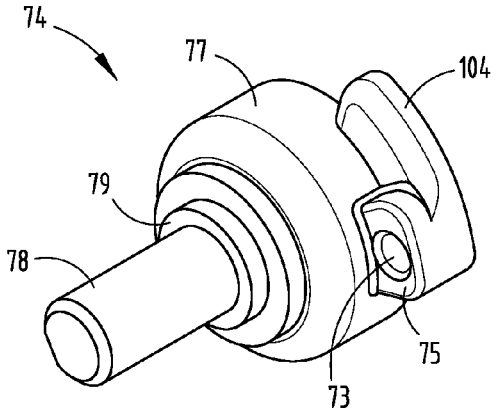
FIG. 12 is an enlarged, perspective view of the lock cam, taken from an interior side thereof.
Figure 13:
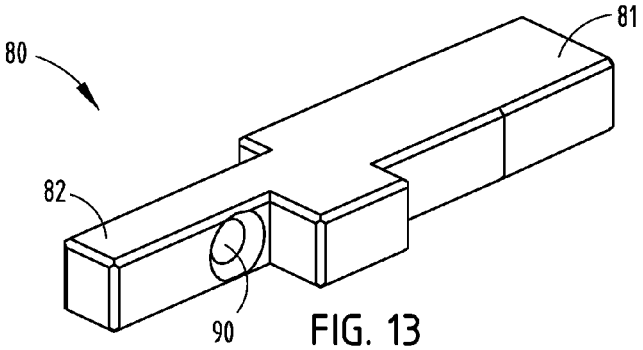
FIG. 13 is an enlarged, perspective view of the deadbolt slide.

In the illustrated example, the movable deadlock key lock member 12 of deadbolt key lock 11 is in the form of a cylindrical lock plug that is received in the lock aperture 27 on the exterior housing plate 22, and is rotatably mounted in lock boss 34 for rotation between locked and unlocked positions. The illustrated lock cam 74, best shown in FIGS. 11-12, has a crank arm 75 that is operably connected with deadbolt lock 10. Cam lock 74 has a cylindrically shaped base 77 with a recessed end 72 oriented toward exterior housing plate 22, a stop or collar 79, and a faced shaft 78 oriented toward interior housing plate 23. A cam actuator 71 is fitted within the recessed end 72 and is coupled to the distal end of deadbolt key lock 11. The recessed end 72 of lock cam 74 is preferably provided with opposed lobes 131 on its interior surface. The face of cam actuator 71 facing the recessed end 72 is preferably provided with a center edge 130. This structure allows the rotation of the deadbolt key lock 11 and cam actuator 71 within the recessed end to rotate the lock cam 74, but likewise allows the lock cam 74 to rotate to a degree independent of and without the necessity of rotation of the deadbolt key lock 11 and cam actuator 71, as discussed below. The base 77 of the lock cam 74 is received within the boss 34 and engages a recess 98 to positively position the lock cam 74 for rotation about its axis only. Also, a lock cam support 99 is provided at the marginal edge of the boss 34 to further restrain the lock cam 74 from extraneous motion, as discussed below. The shaft 78 on cam lock 74 extends through the lock boss 42 in the interior housing plate 23, and lock knob 52 is mounted on the interior end thereof, such that rotation of lock knob 52 from the interior of the vehicle rotates cam lock 74 between the locked and unlocked positions to shift the deadbolt lock 10 between the locked and unlocked positions, as described below.

With reference to FIGS. 4, 4A, 9, and 10, the illustrated deadbolt lock 10 includes a deadbolt 80 slidably mounted in the deadbolt lock slide channel 32 of exterior housing plate 22, and includes an outer end 81 which extends exterior of housing 2 for engagement with doorframe 15, and an inner end 82 which extends interior of housing 2. A first link 83 has a first end 84 thereof pivotally connected with an orifice 90 provided at the inner end 82 of deadbolt 80, and a second end 85 thereof pivotally connected with a first orifice 60 in a motor crank arm 76, which is in turn connected to motor shaft 95 extending from motor 86 mounted to the exterior housing plate 22. Preferably, the motor 86 is a 6 vdc motor capable of 320-340 RPM at 6 vdc with a gear reduction of 100:1, which due to the geometry of the linkages, and along with fact that with two separate linkages the motor need only rotate approximately 100 degrees, provides high-speed actuation capable of activating deadbolt 80 in approximately ¼ second. A second link 87 has a first end 88 thereof pivotally connected with a second orifice 61 in the motor crank arm 76, and a second end 89 thereof pivotally connected to orifice 73 of crank arm 75 of the lock cam 74, such that rotation of motor shaft 95 rotates motor crank arm 76 between the locked and unlocked positions and simultaneously longitudinally shifts the deadbolt 80 between the locked and unlocked positions.

Preferably, the first link 83 and the second link 87 are identical in length, height, gage, and material so as to be interchangeable, preventing assembly error.

Figure 16:
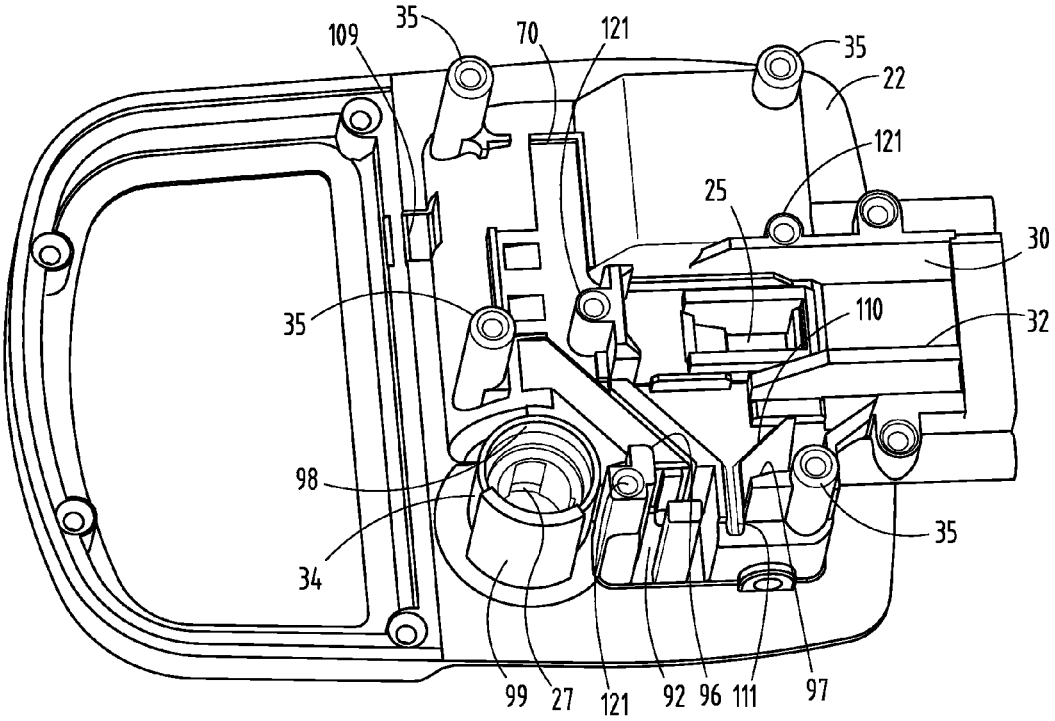
FIG. 16 is a perspective view of the interior side of the exterior plate of the paddle handle latch assembly.

The motor 86 is preferably mounted in a recess pocket 92 integrally molded into the interior side of the exterior plate 22. As best shown in FIG. 16, the pocket 92 is designed to prevent water pooling proximate the motor 86, as further described below. The pocket 92 securely contains the motor 86 from misalignment and provides ease of assembly because the motor 86 is simply slid into the pocket 92. An interconnect board 69, into which the battery power line 46 is connected via a plug, provides power to the touch pad 36 and the motor 86 via wires 108 routed through wire channel 109. The interconnect board 69 also contains a micro switch 105, discussed below, for indicating the locked and unlocked deadbolt 80 positions. Preferably, the interior surface of the exterior plate 22 incorporates a pocket 70 for ease of location and installation of interconnect board 69.

In the illustrated lock assembly 1, the interior backer plate 120 is disposed between the exterior and interior housing plates 22 and 23, covers the interior faces of deadbolt 80 and slide 100, and is attached to fastener bosses 121 on the interior side of exterior housing plate 22 to retain the moving components securely in place.

It is critical to maintain the motor crank arm 76 in position to prevent a false indication given from the switch 105, as discussed below. In other words, it is vital to keep the motor crank arm 76 rotating about a fixed axis. The axis of rotation of the motor crank arm 76 is fixed by a combination of pocket 92, discussed above, as well as a circular pad 93 on the motor crank arm 76 and orifice 94 in the interior backing plate 120 that holds the motor 86 in place. These features prevent the motor crank arm 76 from moving, and yet allow the motor crank arm 76 to freely rotate. Preferably, the interior surface of the exterior plate 22 includes physical stops 96, 97 to prevent the motor crank arm from over rotation and to prevent the deadbolt 80 from being forced to the unlocked position. As for the lock cam 74, stop or collar 79 is sized to extend into recess 124 axially positioned on the back plate 120, so as to prevent the axis of lock cam 74 from moving vertically or horizontally and in rotation only.

Figure 10:
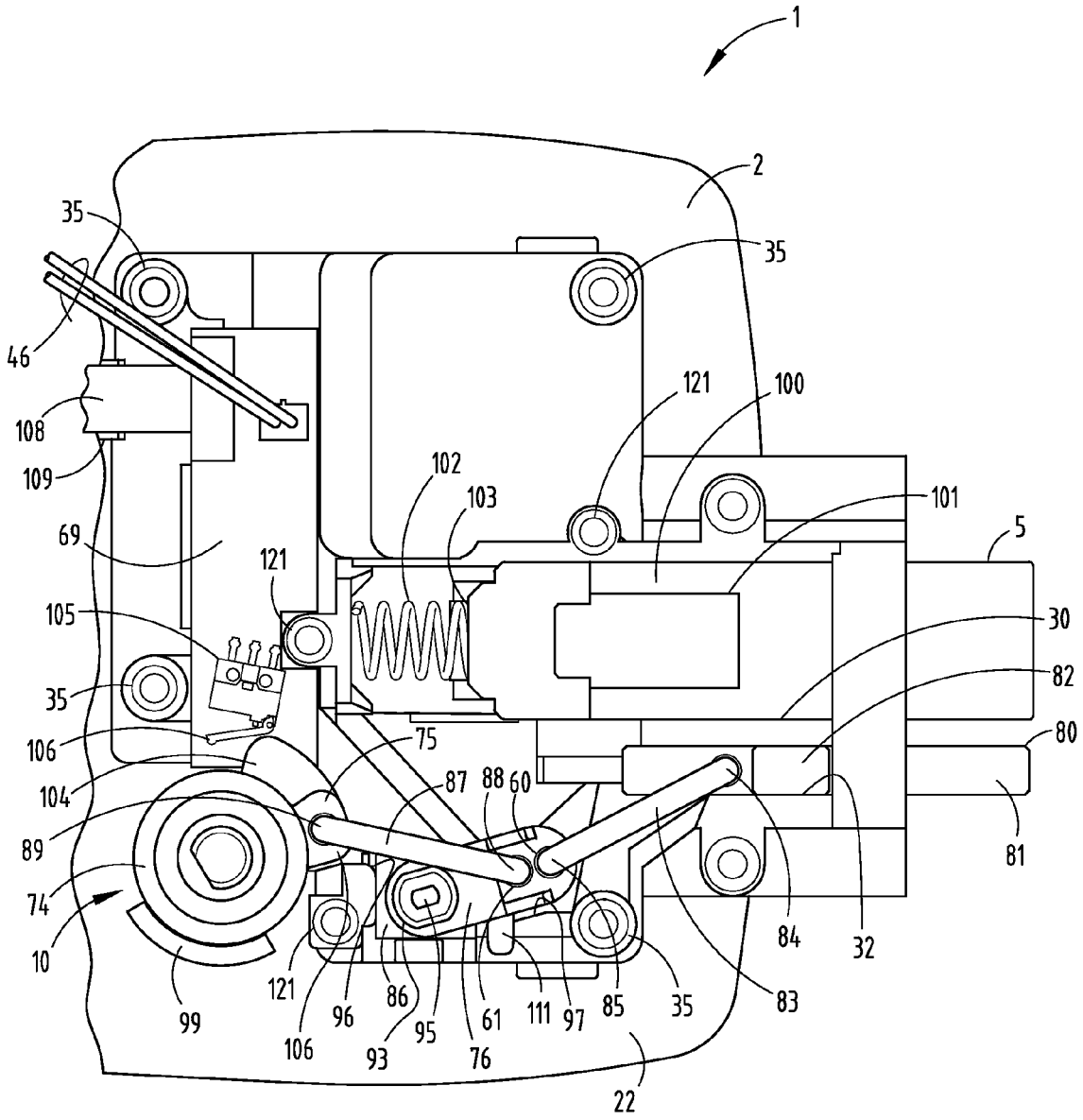
FIG. 10 is an exploded, elevational view of interior portion of the exterior plate of the lock assembly, shown with the latch portion in a latched position, and deadbolt lock portions thereof in a locked position.

Also, importantly, the first link 83 and second link 87 are preferably in end-to-end relationship with one another when in the locked position, as shown in FIG. 10, to positively place the motor crank arm 76 in a locked position (past parallel with deadbolt 80) such that the deadbolt 80 cannot be externally pushed back into handle assembly 1 without rotation via actuation by the motor 86, deadbolt lock 10, or interior lock knob 52.

The illustrated latch 5 includes a pocketed slide 100 which is slidably mounted in the latch slide channel 30 on the inside surface of exterior housing plate 22 for laterally shifting between latched and unlatched positions. Slide 100 has an exterior pocket 101 into which the actuator tab 26 on paddle handle 4 is received, such that shifting paddle handle 4 from the exterior of the vehicle between the retracted and extended positions longitudinally shifts slide 100 in a lateral direction between the latched position shown in FIG. 2 and the unlatched position shown in FIG. 1. Slide 100 has an interior pocket 47 into which the actuator tab 51 on release lever 50 is received, such that shifting release lever 50 from the interior of the vehicle similarly shifts slide 100 between the latched and unlatched positions. A coil spring 102 is mounted in the latch slide channel 30 and is abuttingly received in a centering hole 107 in the rearward side edge 103 of slide 100 to urge slide 100 toward the normally latched position shown in FIGS. 2 and 3.

In operation, closure 3 can be shifted from the closed to the open position from the exterior of the vehicle in the following manner. With the locking paddle handle 4 in the unlocked position via key 126 and the deadbolt lock 10 in the unlocked position, paddle handle 4 may be rotated outwardly from the retracted position to the extended position. Rotation of paddle handle 4 from the retracted position to the extended position pivots actuator tab 26 laterally, which, in turn, moves slide 100 laterally inwardly. The lateral inward shifting of slide 100 causes the latch 5 to shift to the unlatched position. The latch 5 thereby disengages from the door recess 16, and permits the user to shift closure 3 from the closed position to the open position, as shown in FIG. 1.

Closure 3 can be similarly shifted from the closed position to the open position from the interior of the vehicle in the following manner. With the locking paddle handle 4 in either of the locked or unlocked positions and the deadbolt lock 10 in the unlocked position, release handle 50 may be rotated laterally inwardly from the retracted position to the extended position, which pivots actuator tab 51 laterally, and moves slide 100 inwardly. The inward shifting of slide 100 also causes the latch 5 to shift to the unlatched position. The latch 5 thereby disengages from the door strike recess 16, and permits the user to shift closure 3 from the closed position to the open position, as shown in FIG. 1.

In order to return the closure 3 to the closed and latched position from either the exterior or interior of the vehicle, the user simply shifts closure 3 to the closed position, which causes an inclined surface 18 on latch 5 to strike the door strike 15 and thereby push latch 5 into the interior of the lock assembly 1. When the latch 5 comes into registry with the door strike recess 16, the latch 5 is urged back to the latched position by virtue of the spring biasing force exerted by coil spring 102, thereby preventing the door from being inadvertently shifted from the closed position to the open position.

When the closure 3 is in the fully closed and latched position, the same can be positively locked in place by rotation of lock plug 11. More specifically, a matching key 128 is inserted into the key slot 129 in deadbolt lock plug 11, and the same are then rotated from the unlocked position to the locked position. Rotation of lock plug 11 rotates lock cam 74, which, in turn, contemporaneously shifts the crank arm 75 of lock cam 74, second link 87 pivotally connected with motor crank arm 76, motor crank arm 76, first link 83 pivotally connected with motor crank arm 76 and the inner end 82 of deadbolt 80, and deadbolt 80 from the unlocked to the locked position. In the locked position, deadbolt 80 engages door strike recess 17 in the door strike 15, and positively prevents opening of the door. The deadbolt lock 10 is unlocked by rotating key 128 and associated lock plug 11 in the opposite direction. The deadbolt lock 10 can be similarly shifted between the locked and unlocked positions from the interior of the closure 3 by rotation of interior lock knob 52.

The closure 3 can also be positively locked in place by actuation of touchpad 36. In practice, a numerical code is programmed on the microchip or controller 45 at the time of manufacture of the lock assembly 1. Preferably, the original code is null-code, such as 0000. After purchase by the end-user, the code can be modified and customized to the end-user's preference. Preferably, the code may be repeatedly changed as deemed appropriate by the end-user. Once the predetermined numerical code is entered into the buttons 37 of touchpad 36, the controller 45 receives a signal that the closure 3 is to be placed in the locked mode. The controller 45 then opens a switch to send electrical power to actuate the lock motor 86. Upon actuation of the lock motor 86, the lock motor 86 rotates the motor crank arm 76 clockwise, which shifts the first link 83 pivotally connected with motor crank arm 76 and the inner end 82 of deadbolt 80, and deadbolt 80 from the unlocked to the locked position. In the locked position, deadbolt 80 engages door strike recess 17 in the doorframe 15, and positively prevents opening of the door. The crank arm 75 of lock cam 74 and second link 87, pivotally connected with motor crank arm 76, are also placed in the locked position. The deadbolt lock 10 is unlocked by re-entry of the predetermined numerical code and subsequent rotation of the lock motor counterclockwise.

The controller 45 is a standard printed circuit board, as is known in the art. Moreover, addition to actuating the deadbolt as described above, the controller 45 is useful in other tasks, such as monitoring the state of battery charge. In particular, the controller 45 can be programmed to activate a warning indicator, such as a blinking illuminator behind the buttons 37 upon entry of the code or a light emitting diode (LED) telltale (not shown), upon the battery charge dropping below a predetermined level, advising the end-user that the batteries should be replaced.

However, in the event of an electrical problem with the lock assembly 1, the deadbolt 80 can still be activated by a key or internal deadbolt knob 52. That is, the deadbolt 10 can be similarly shifted between the locked and unlocked positions from the interior of the vehicle by rotation of interior lock knob 52 and from the exterior of the vehicle by rotation of the deadbolt key lock 11.

Figure 14:
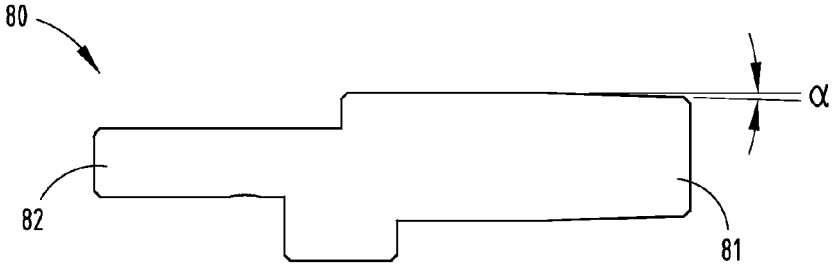
FIG. 14 is an enlarged, elevational view of the deadbolt slide.
Figure 15:
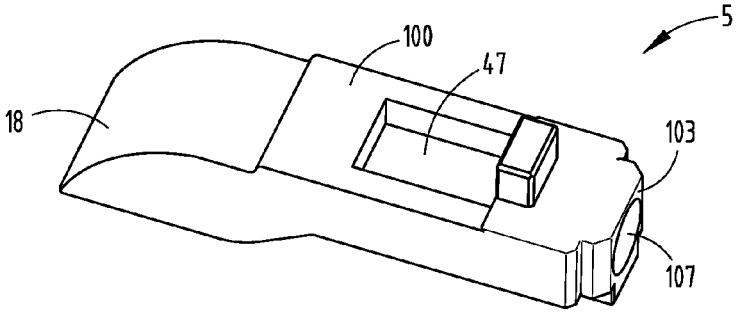
FIG. 15 is an enlarged, perspective view of the latch lock.

Preferably, the deadbolt outer end 81 is slightly tapered toward its distal end, as indicated by angle $\alpha$ shown in FIG. 14. Also, the deadbolt end 81 is preferably narrower than the latch 5 in cross-sectional lateral thickness, as indicated by gap G shown in FIG. 5. That is, with the latch 5 engaged into the door strike recess 16, it should be impossible for the deadbolt outer end 81 to be obstructed from its insertion into the door strike recess 17, assuming the door strike recess 17 has the same lateral width as the door strike recess 16. This prevents misalignment and reduces drag for the motor 86. This is an important feature because closures 3 may be installed out of square or the hinges may sag, making activation of the deadbolt 80 difficult. For proper operation and long life, there must be little resistance to the electric motor. Therefore, eliminating any possible interference for the deadbolt 80 is highly desirable. For similar reasons, the contact surface area between the deadbolt slide 80 and deadbolt slide channel 32 in the housing 2 should be minimized to reduce friction as much as possible.

In the preferred example, the buttons 37 of the touchpad 36 are preferably relatively large, illuminated, capacitive touch technology buttons rather than mechanical buttons. Preferably, the buttons have a diameter of at least one-half inch, with black numerical indicia against a white background. Also, a sensor 64 is preferably disposed on the controller 45 and extends to the external surface of the exterior housing plate 22 for determining the proximity of a hand of a user. Illuminators that illuminate the buttons 37 of the touchpad 36, such as LEDs, are disposed below the buttons 37, which are preferably translucent. Upon detection of the user's hand, the controller 45 activates the LEDs to backlight the numerical indicia 38 to facilitate entry of the code. After a predetermined period of non-use, the LEDs are deactivated to conserve battery power. Alternatively, the illuminators may be actuated by depression of any of the buttons 37.

Additionally, audible feedback may be provided to successfully indicate locking and unlocking functions. For example, audible features may also be used to: signal that the assembly is ready to accept new code by emitting three short beeps; signal that a new code is entered by emitting four short beeps; signal that an incorrect code was entered with one long beep; signal that the deadbolt 80 is locked or unlocked with two short beeps; signal that the deadbolt 80 failed to lock or unlock with one long beep; and signal low battery charge with one long beep after the lock/unlock beeps. Preferably, the controller 45 is programmed such that the assembly will cycle up to ten more times once the low battery indication occurs. After this, the final electric function in a low battery condition preferably implements a protocol to prevent the electronic locking function.

Figure 9:
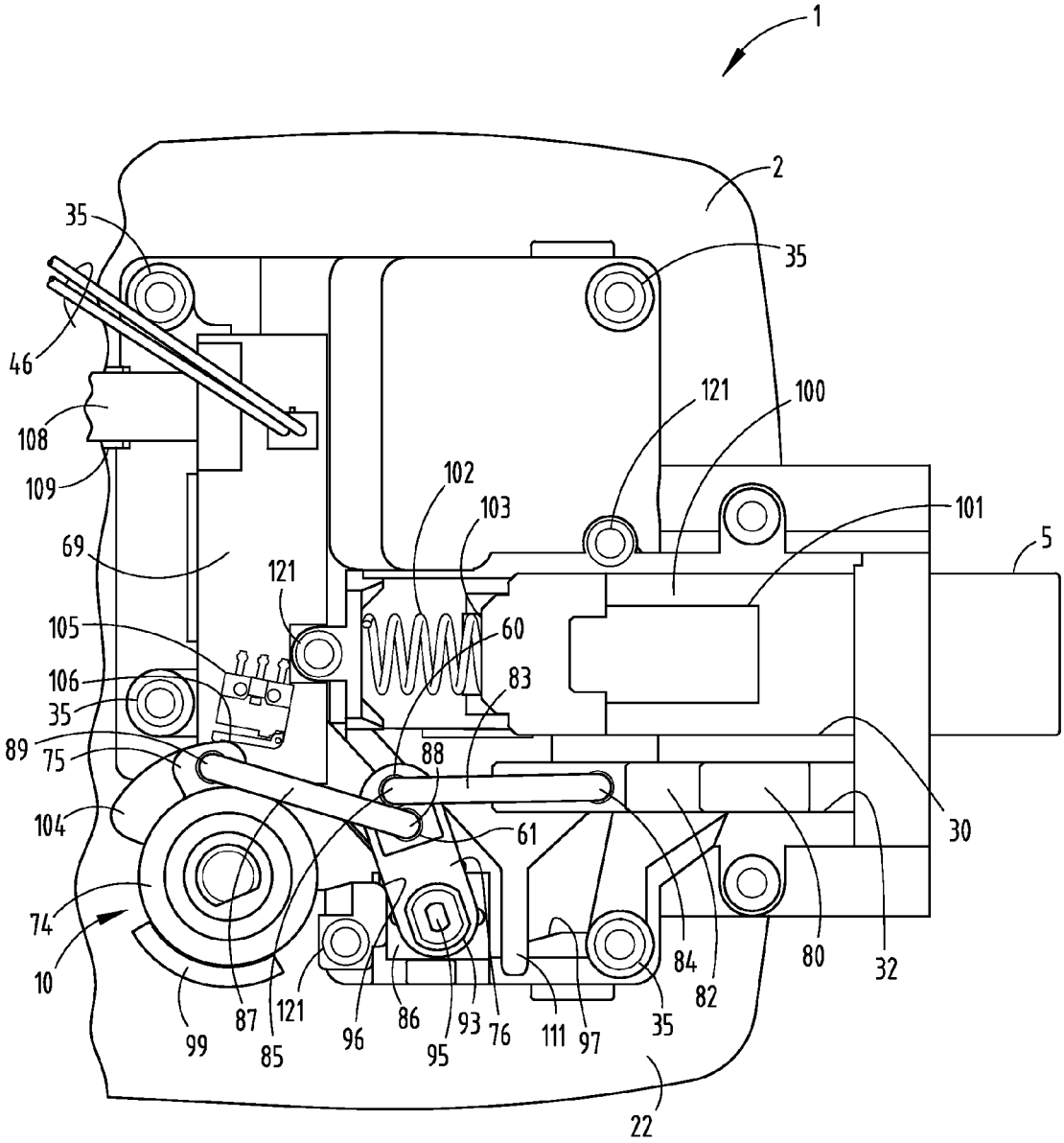
FIG. 9 is an exploded, elevational view of the interior portion of the exterior plate of the lock assembly, shown with the latch portion in a latched position, and latch lock and deadbolt lock portions thereof in an unlocked position.

The lock assembly 1 can also be equipped to sense the position of the deadbolt 80 and to determine if there is an obstruction to the dead bolt. As best seen in FIGS. 9 and 10, a sensor cam 104 is located approximately at 45 degrees counterclockwise from the lock crank arm 75, the sensor cam 104 having a projecting height approximately that of the lock crank arm 75. A micro switch 105 is mounted on the interior surface of the exterior housing plate 22, the micro switch having a first end 106 positioned to be released by the sensor cam 104 of the lock crank arm 75 when the deadbolt is in the locked position and depressed by the sensor cam 104 when the deadbolt in the unlocked position. Thus, depending on whether the micro switch 105 is depressed, the controller 45 is advised as to the state of the lock assembly 1.

The lock assembly 1 described herein may also be adapted for operable connection with a remotely operated signaling device (such as a key fob) (not shown). That is, the controller 45 may be programmed to interface with a built-in receiver to receive a signal from a remotely operated signaling device equipped with a transmitter to place the lock assembly 1 in the locked mode. In response to such a signal, the controller 45 then opens a switch to send electrical power to actuate the lock motor 86. Upon actuation of the lock motor 86, the lock motor 86 rotates the motor crank arm 76 clockwise, which shifts the first link 83 pivotally connected with motor crank arm 76 and the inner end 82 of deadbolt 80, and deadbolt 80 from the unlocked to the locked positions. The closure 3 may be unlocked in similar fashion.

Given the presence of the controller 45 and motor 86, the presence of water internal to the lock assembly 1 is highly undesirable and it is highly desirable to allow the water to exit the lock assembly 1. Accordingly, diversion channels 110 are provided on the internal surface of the external plate 22 to divert water between the external plate and the internal plate away from the motor 86 and controller 45, regardless of how the lock assembly 1 might be mounted to the closure 3, as shown in FIGS. 2-3. For example, in the case of the lock assembly 1 being mounted on the right side of the closure 3, from inside the closure 3, as shown in FIGS. 1-3, the diversion channels 110 form a funnel 111 next to the motor 86 so that the water preferentially flows harmlessly by, but not in touch with, the motor 86. In the case of the lock assembly 1 being mounted on the left side of the closure 3, from inside the closure 3 (not shown), the motor is located relatively high in the lock assembly 1, such that any water in the lock assembly 1 flows away from the motor 86 and out of the lock assembly 1.

Additional water control may be obtained by the use of water diversion provided on the external surface of the exterior housing plate 22. The water diversion includes an elevated rib 113 extending completely about handle recess 24. Water encountering the elevated rib 113 will tend to flow around the handle recess 24 due to capillary action and then fall to the ground. A similar elevated rib 114 is formed around lock aperture 27 on the surface of the exterior housing plate 22. An elevated, generally triangularly shaped base 115 having channels 116 on either angled side is formed near the actuator window 25, such that water flowing near the actuator window 25 is forced to flow away from the actuator window 25 and does not flow into the interior of the lock assembly 1 in the first instance. Due to the symmetrical wedge-shape of the base 115, the assembly may be mounted on either right-hand or left-hand hinged doors. Additionally, a web 117, best shown in FIG. 4, is provided on tab 26 to prevent water from entering the interior of the housing 2 via the actuator window 25 in the event that water is sprayed directly at the exterior handle 4. That is, the web 117 effectively seals window 25 when the handle 4 is in the retracted position.

In accordance with the foregoing description, an improved lock assembly has been disclosed which includes an integral touchpad lock control coupled with a handle mechanism that is convenient for the consumer, in that keys and key fobs are not needed to actuate the lock. Relatively large, illuminated capacitive touch buttons allow for ease of use. The described latch assembly readily fits in existing RV doors and consumers can replace existing mechanical travel trailer latch with the improved latch assembly. This is especially made possible due to the self-contained power source of the improved latch assembly that requires no external wiring.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A lock assembly adapted for mounting adjacent an associated closure of the type that can be shifted between an open position and a closed position, the lock assembly, comprising:

a housing;

an external handle pivotally mounted in an exterior portion of the housing for rotation between a retracted position and an extended position;

a latch operably connected with the external handle and configured such that when the external handle is in the retracted position, the latch is in a latched position, wherein the closure cannot be unintentionally shifted from the closed position, and when the external handle is in the extended position, the latch is in an unlatched position, wherein the closure is free to be shifted from the closed position to the open position;

a key lock mounted on the exterior portion of the housing, where the key lock has a locked and an unlocked position;

a lock cam rotatably mounted in the housing and operably connected with the key lock for rotation therewith, the lock cam having a lock cam crank arm;

a first link operably connected with the lock cam crank arm;

a deadbolt lock movably mounted in the housing for shifting between a locked position, wherein the closure is positively retained in the closed position, and an unlocked position, wherein the closure is free to be shifted between the open and closed positions;

the deadbolt lock being operably connected with the first link;

a motor having a locked and unlocked position operatively connected with the first link; and an electronic touchpad mounted on the exterior portion of the housing being operatively connected with the motor, whereby entry of a preselected numerical code actuates the motor and contemporaneously shifts the deadbolt lock between the locked and unlocked positions.

2. A lock assembly as set forth in claim 1, including:

a motor crank arm operably connected with the first link and the motor to shift the deadbolt lock between the locked and unlocked positions.

3. A lock assembly as set forth in claim 2, including:

a second link operably connected with the motor crank arm and the deadbolt lock, wherein rotation of the lock cam operates through the second link to rotate the motor crank arm and rotation of the motor crank arm operates through the first link to shift the deadbolt lock between the locked and unlocked positions.

4. A lock assembly as set forth in claim 3, wherein actuation of the motor operates through the second link to rotate the lock cam and through the first link to shift the deadbolt lock between the locked and unlocked positions.

5. A lock assembly as set forth in claim 4, wherein:

the deadbolt lock includes a deadbolt slidably mounted in the housing with an outer end thereof which extends exterior of the housing for engagement with an associated strike adjacent the closure, an inner end thereof which extends interior of the housing, the first link having a first end thereof pivotally connected with the inner end of the deadbolt lock, and a second end thereof pivotally connected with a motor crank arm, such that actuation of the motor between the locked and unlocked positions longitudinally shifts the deadbolt lock between the locked and unlocked positions.

6. A lock assembly as set forth in claim 5, wherein:

the second link has a first end thereof pivotally connected with the lock cam crank arm and a second end thereof pivotally connected with the crank arm of the motor, such that rotation of the key lock between the locked and unlocked positions longitudinally shifts the deadbolt lock between the locked and unlocked positions.

7. A lock assembly as set forth in claim 6, including:

a fixed interior handle operably connected with an interior portion of the housing and shaped to facilitate manually shifting the closure between the open and closed positions from an interior side of the closure, the fixed handle having a ramp-shaped leading edge to avoid interference with an adjacent sliding closure.

8. A lock assembly as set forth in claim 7, including:

an interior lock actuator mounted on the interior portion of the housing, and operably connected with the lock cam for rotation therewith, such that shifting the interior lock actuator between locked and unlocked positions shifts the deadbolt lock between the locked and unlocked positions.

9. A lock assembly as set forth in claim 8, wherein:

the external handle includes an external handle key lock assembly and a protruding lock pawl which rotates with the external handle key lock assembly between a locked and an unlocked position; and a handle recess in the exterior portion of the housing for receiving the external handle, the handle recess having a lock recess that engages the protruding lock pawl to prevent the external handle from pivoting when the external handle key lock assembly is placed in the locked position.

10. A lock assembly as set forth in claim 5, wherein the slideable deadbolt has a cross-sectional lateral thickness that is narrower than a cross-sectional lateral thickness of the latch.

11. A lock assembly as set forth in claim 10, wherein an outer end of the slideable deadbolt is tapered.

12. A lock assembly as set forth in claim 5, wherein:

the latch has an outer end that extends exterior of the housing for engagement with an associated latch strike having a door strike recess and an inner end thereof which extends interior of the housing, the outer end of the latch further having an inclined surface that faces the door strike recess on the strike; and said slideable deadbolt lock having an outer end that extends exterior of the housing for engagement with an associated deadbolt strike.

13. A lock assembly as set forth in claim 3, wherein rotation of the lock cam and the motor crank arm to shift the deadbolt lock to the locked position places the first and second link in substantially end to end relationship.

14. A lock assembly as set forth in claim 1, further comprising water diversion channels disposed on an internal surface of an exterior plate to divert water between the exterior plate and an internal plate away from the motor.

15. A lock assembly as set forth in claim 14, further comprising water diversion ribs provided on an external surface of the exterior plate to divert water on the external surface of the exterior plate away from the external handle and the internal surface of the exterior plate.

16. A lock assembly as set forth in claim 14, further comprising water diversion ribs provided on an external surface of the exterior plate to divert water on the external surface of the exterior plate away from the handle and the internal surface of the exterior plate.

17. A lock assembly as set forth in claim 1, wherein the electronic touchpad further comprises a controller.

18. A lock assembly as set forth in claim 17, further comprising a device to sense the position of the deadbolt lock and to determine whether the deadbolt lock is in the locked or unlocked position.

19. A lock assembly as set forth in claim 18, further comprising a sensor cam positioned on the lock cam and wherein the device to sense the position of the deadbolt lock and to determine whether the deadbolt lock is in locked or unlocked position includes a micro switch mounted such that when the deadbolt lock is moved to the unlocked position, the sensor cam depresses the micro switch for determining whether the deadbolt lock is in the locked or unlocked position to signal that the deadbolt lock is in the unlocked position, and when the deadbolt lock is moved to the locked position, the micro switch is not depressed to signal that the deadbolt lock is in locked position.

20. A lock assembly as set forth in claim 19 wherein failure of the sensor cam to depress the micro switch within a predetermined time interval signals to the controller that the deadbolt lock is not free to move from the unlocked to the locked position.

21. A lock assembly as set forth in claim 17, comprising a battery pack for powering the controller and further comprising a sensor for determining the charge of the battery pack and a signaling device responsive to a low battery charge.

22. A lock assembly as set forth in claim 17, further comprising a sensor for determining the proximity of a hand of a user and illuminators that illuminate the touchpad to facilitate entry of the code in response to a signal from the sensor for determining the proximity of a hand of a user.

23. A lock assembly as set forth in claim 17 wherein the preselected numerical code can be modified by a user of the touchpad.

24. A lock assembly as set forth in claim 3, wherein the first link and the second link are interchangeable.

25. A lock assembly adapted for mounting on an associated closure and the like of the type that can be moved between an open position and a closed position and an opening in the closure extending between an exterior and an interior surface of the closure, the lock assembly comprising:

a housing having an exterior plate juxtaposed against the exterior surface of the closure and an interior plate juxtaposed against the interior surface of the closure, the exterior and interior plates attached one to the other between the exterior and interior surface of the closure;

a handle pivotally mounted upon the exterior plate of the housing for rotation between a retracted position and an extended position;

a latch operably connected with the handle, and configured such that when the handle is in the retracted position, the latch is in a latched position, wherein the closure cannot be unintentionally shifted from the closed position, and when the handle is in the extended position, the latch is in an unlatched position, wherein the closure is free to be moved from the closed position to the open position;

a key lock mounted on the exterior plate of the housing, where the key lock has a locked and an unlocked position;

a lock cam rotatably mounted in the housing and operably connected with the key lock for rotation therewith, the lock cam having a crank arm;

a first link operably connected with the crank arm;

a deadbolt lock movably mounted in the housing for shifting between a locked position, wherein the closure is positively retained in the closed position, and an unlocked position, wherein the closure is free to be shifted between the open and closed positions;

the deadbolt lock being operably connected with the first link;

a motor operatively connected with the first link;

an electronic touchpad mounted on an exterior portion of the housing being operatively connected with the motor, whereby entry of a preselected numerical code actuates the motor and contemporaneously shifts the deadbolt lock between the locked and unlocked positions; and water diversion channels provided on an internal surface of the exterior plate to divert water between the exterior plate and the interior plate away from the motor.

26. A lock assembly adapted for mounting adjacent an associated closure of the type that can be shifted between an open position and a closed position, comprising:

a housing;

an external handle pivotally mounted in an exterior portion of the housing for rotation between a retracted position and an extended position;

a latch operably connected with the external handle and configured such that when the external handle is in the retracted position, the latch is in a latched position, wherein the closure cannot be unintentionally shifted from the closed position, and when the external handle is in the extended position, the latch is in an unlatched position, wherein the closure is free to be shifted from the closed position to the open position;

a key lock mounted on the exterior portion of the housing, where the key lock has a locked and an unlocked position;

a lock cam rotatably mounted in the housing and operably connected with the key lock for rotation therewith, the lock cam having a lock cam crank arm;

a first link operably connected with the lock cam crank arm;

a deadbolt lock movably mounted in the housing for shifting between a locked position, wherein the closure is positively retained in the closed position, and an unlocked position, wherein the closure is free to be shifted between the open and closed positions;

the deadbolt lock being operably connected with the first link;

a motor having a locked and unlocked position operatively connected with the first link;

a motor crank arm operably connected with the first link and the motor to shift the deadbolt lock between the locked and unlocked positions;

a second link operably connected with the motor crank arm and the deadbolt lock, wherein rotation of the lock cam operates through the second link to rotate the motor crank arm and rotation of the motor crank arm operates through the first link to shift the deadbolt lock between the locked and unlocked positions; and an electronic touchpad mounted on the exterior portion of the housing being operatively connected with the motor, whereby entry of a preselected numerical code actuates the motor and contemporaneously shifts the deadbolt lock between the locked and unlocked positions, wherein actuation of the motor operates through the second link to rotate the lock cam and through the first link to shift the deadbolt lock between the locked and unlocked positions.

27. A lock assembly as set forth in claim 26, wherein:

the deadbolt lock includes a deadbolt slidably mounted in the housing with an outer end thereof which extends exterior of the housing for engagement with an associated strike adjacent the closure, an inner end thereof which extends interior of the housing, the first link having a first end thereof pivotally connected with the inner end of the deadbolt lock, and a second end thereof pivotally connected with a motor crank arm, such that actuation of the motor between the locked and unlocked positions longitudinally shifts the deadbolt lock between the locked and unlocked positions.

28. A lock assembly as set forth in claim 27, wherein:

the second link has a first end thereof pivotally connected with the crank arm of the lock cam and a second end thereof pivotally connected with the motor crank arm, such that rotation of the key lock between the locked and unlocked positions longitudinally shifts the deadbolt lock between the locked and unlocked positions.

29. A lock assembly as set forth in claim 28, including:

a fixed interior handle operably connected with an interior portion of the housing and shaped to facilitate manually shifting the closure between the open and closed positions from an interior side of the closure, the fixed handle having a ramp-shaped leading edge to avoid interference with an adjacent sliding closure.

30. A lock assembly as set forth in claim 29, including:

an interior lock actuator mounted on the interior portion of the housing, and operably connected with the lock cam for rotation therewith, such that shifting the interior lock actuator between locked and unlocked positions shifts the deadbolt lock between the locked and unlocked positions.

31. A lock assembly as set forth in claim 30, wherein:

the external handle includes an external handle key lock assembly and a protruding lock pawl which rotates with the external handle key lock assembly between a locked and an unlocked position; and a handle recess in the exterior portion of the housing for receiving the external handle, the handle recess having a lock recess that engages the protruding lock pawl to prevent the external handle from pivoting when the external handle key lock assembly is placed in the locked position.

32. A lock assembly as set forth in claim 27, wherein the slideable deadbolt has a cross-sectional lateral thickness that is narrower than a cross-sectional lateral thickness of the latch.

33. A lock assembly as set forth in claim 32, wherein an outer end of the slideable deadbolt is tapered.

34. A lock assembly as set forth in claim 27, wherein:

the latch has an outer end that extends exterior of the housing for engagement with an associated latch strike having a door strike recess and an inner end thereof which extends interior of the housing, the outer end of the latch further having an inclined surface that faces the door strike recess on the strike; and the slideable deadbolt having an outer end that extends exterior of the housing for engagement with an associated deadbolt strike.

* * * * *